US008059053B2

(12) United States Patent
Miyazaki et al.

(10) Patent No.: US 8,059,053 B2
(45) Date of Patent: Nov. 15, 2011

(54) ANTENNA AND RADIO-WAVE RECEIVING DEVICE PROVIDED WITH ANTENNA

(75) Inventors: Ryo Miyazaki, Tokyo (JP); Nobuhiro Sato, Saitama (JP)

(73) Assignee: Citizen Holdings Co., Ltd. (JP)

( * ) Notice: Subject to any disclaimer, the term of this patent is extended or adjusted under 35 U.S.C. 154(b) by 405 days.

(21) Appl. No.: 12/293,481

(22) PCT Filed: Mar. 22, 2007

(86) PCT No.: PCT/JP2007/055832

§ 371 (c)(1),
(2), (4) Date: Dec. 17, 2008

(87) PCT Pub. No.: WO2007/108502

PCT Pub. Date: Sep. 27, 2007

(65) Prior Publication Data

US 2009/0207083 A1 Aug. 20, 2009

(30) Foreign Application Priority Data

Mar. 22, 2006 (JP) ..... 2006-078905
Aug. 17, 2006 (JP) ..... 2006-222375

(51) Int. Cl.
*H01Q 7/08* (2006.01)

(52) U.S. Cl. ..... 343/788; 343/718; 343/895; 368/47

(58) Field of Classification Search ..... 343/718, 343/788, 895; 368/47, 88
See application file for complete search history.

(56) References Cited

U.S. PATENT DOCUMENTS

| | | | |
|---|---|---|---|
| 6,927,739 | B2 | 8/2005 | Nomura et al. |
| 7,170,462 | B2 | 1/2007 | Ihara et al. |
| 7,433,273 | B2 | 10/2008 | Oguchi et al. |
| 7,511,679 | B2 | 3/2009 | Araki et al. |
| 2008/0094942 | A1 | 4/2008 | Oguchi et al. |

FOREIGN PATENT DOCUMENTS

| | | | |
|---|---|---|---|
| EP | 1455249 | A2 | 9/2004 |
| EP | 1548875 | A1 | 6/2005 |
| JP | 6028531 | A | 2/1994 |
| JP | 6028532 | A | 2/1994 |
| JP | 2000114854 | A | 4/2000 |
| JP | 2004235701 | A | 8/2004 |
| JP | 2004274609 | A | 9/2004 |
| JP | 2005003675 | A | 1/2005 |
| JP | 2006343240 | A | 12/2006 |
| WO | 2005053096 | A1 | 6/2005 |

*Primary Examiner* — Tho G Phan
(74) *Attorney, Agent, or Firm* — The Webb Law Firm

(57) ABSTRACT

An antenna that can ensure a sufficient radio receiving level and a radio-wave receiving device on which the antenna is equipped are provided. The antenna includes a columnar magnetic core formed by a ferromagnetic body, a coil portion wound around the magnetic core, a flat-plate state extension portion extended from an end portion of the magnetic core, and a standing portion provided at least on a one-direction face of the extension portion. Such antenna is suitable for installation on a wrist-watch type radio controlled timepiece, particularly requiring a reduction in size and weight. By this arrangement, while the time display dial is more easily viewable, the radio controlled timepiece ensures that a sufficient standard-wave receiving level is provided.

18 Claims, 25 Drawing Sheets

(a)
8
16
9
7
1

5
4
3
2
8
4
5
7
1
9

5
8
7
1

(a)

(b)

(a)

(b)

(a)

(b)

(a)

(b)

(a)

(b)

ANTENNA AND RADIO-WAVE RECEIVING DEVICE PROVIDED WITH ANTENNA

TECHNICAL FIELD

The present invention relates to an antenna arranged inside a radio-wave receiving device for receiving a radio wave having information, such as a radio wrist watch, wrist-watch type pager, cellular phone, portable TV set, portable radio and the like and the radio-wave receiving device provided with the antenna, and in more detail, to an antenna for radio controlled timepiece having a function of receiving a predetermined radio wave including time information and correcting time based on the information, and particularly to an antenna for wrist-watch type radio controlled timepiece and a radio controlled timepiece provided with the antenna for radio controlled timepiece.

BACKGROUND ART

The radio controlled timepiece is a timepiece provided with a function of receiving a standard wave (40 kHz radio wave, for example) including time information and date information by a cesium atomic clock with an accuracy of 1 second in 1 million years by a built-in antenna for correcting a time error. Thus, accurate time can be displayed all the time as compared with a quartz timepiece in which an error of approximately 20 seconds per month is generated, and labor to correct time can be omitted and thus, the radio controlled timepiece has been rapidly prevailing in these days.

In the radio controlled timepiece, its receiving performance is determined by an antenna characteristic and a receiving-circuit characteristic.

As a type of the antenna, a coil-like bar antenna in which a conductor is wound around a core formed by a ferromagnetic body and the like is generally used since the wavelength of the standard wave is as long as approximately 5 km and resonance by a wavelength direction in the wrist watch is difficult. An electromotive force is obtained at a coil by a magnetic flux transmitted through the bar antenna.

A receiving circuit detects time information based on an output of the antenna and transmits it to a watch movement. The watch movement refers to complex components in which a battery and circuit elements such as a count circuit required for a watch operation are collected up in a single unit. Depending on the cases, a time display measure such as a dial plate, a liquid crystal display device and the like may be included.

The wrist-watch type radio controlled timepiece has a role as an article of taste other than a function as a watch, and its design and texture are important. Particularly, a sense of high-class feeling as a watch is an important element, and metal exterior constituting the exterior of a watch body by metal is desired.

However, an output of an antenna is extremely lowered if housed in the metal exterior. That is because an eddy current is generated on the surface of the metal exterior, which makes difficult for the standard wave to enter the inside of the watch and a magnetic flux generated by an electric current flowing through the antenna is prevented by a counter magnetic flux by the eddy current generated on the surface of the metal exterior and the current flowing through the antenna is prevented.

That is, the wrist-watch type radio controlled timepiece has a problem that the standard wave is difficult to be received with the metal exterior though it is desired. Thus, there are many proposals made for an art with which receiving is possible even in the metal exterior. For example, it is an art to improve the shape of the antenna. By increasing a receiving sensitivity of the antenna, more standard wave can be received.

The wrist-watch type radio controlled timepiece uses a bar antenna in many cases as mentioned above, and an art that the receiving sensitivity is increased by improving the shape of a magnetic core of the bar antenna is known (See Patent Document 1, Patent Document 2, for example).

FIG. 26 is a diagram for explaining a related art shown in Patent Document 1 and is modified for ease of explanation without departing from its gist. In FIG. 26, reference numeral 100 denotes a watch exterior, 102 for a magnetic core, 103 for a coil wound in the longitudinal direction of the magnetic core 102, and 104 for an extension portion of the magnetic core 102. The coil 103 actually has a thin wire wound in order, but for ease of understanding, it is shown cylindrically. In addition, portions not necessary for the explanation are omitted.

As shown in FIG. 26, the related art shown in Patent Document 1 is provided with the extension portion 104 on both sides of the magnetic core 102, and by directing the extension portion 104 toward the side of a windshield glass (not shown), much more magnetic flux is led to the magnetic core 102 with respect to the standard wave incident from the windshield glass side.

FIG. 27 is a diagram for explaining a related art shown in Patent Document 2 and is modified for ease of explanation without departing from its gist. In FIG. 27, reference numeral 100 denotes a watch exterior, 102 for a magnetic core, 103 for a coil wound in the longitudinal direction of the magnetic core 102, 104 for an extension portion of the magnetic core 102, and 106 is a radio-wave collection plate connected to the extension portion 104. Similarly to FIG. 26, the coil 103 is shown cylindrically. Note that, portions not necessary for the explanation are omitted.

As shown in FIG. 27, in the related art shown in Patent Document 2, the radio-wave collection plate 106 is connected to the extension portion 104 of the magnetic core 102 so as to be curved in the watch exterior 100. With such configuration, more standard wave entering the watch exterior 100 can be led to the magnetic core 102 and in addition, directions where the radio controlled timepiece can receive the standard wave are increased. The wrist-watch type radio controlled timepiece is worn on an arm and its direction is changed in various ways according to an action of a human body, and increase in the directions capable of receiving a wave is effective.

Patent Document 1: Japanese Patent Laid-Open Publication No. 2005-3675 (page 15, FIG. 11)

Patent Document 2: Japanese Patent Laid-Open Publication No. 2004-235701 (pages 5 to 7, FIG. 3)

The related arts shown in Patent Document 1, Patent Document 2 both consider the case where the watch exterior 1 is metal and a flow of the magnetic flux is not prevented by the metal exterior. However, with these structures, it is known that more standard wave cannot be received.

That is, with the related art shown in Patent Document 1, since the extension portion 102 is merely extended from the magnetic core, when seen from the windshield glass side (not shown), of the watch exterior 1, the extension portion 102 is small in the planar view and is not in a structure to receive more standard wave. With such structure, the magnetic flux cannot be obtained effectively.

Moreover, if a time display measure such as a dial plate, a liquid crystal display device and the like is provided on a top portion of the antenna, they shield the standard wave, and even with presence of the extension portion 102, the standard wave can not be received effectively.

In the related art shown in Patent Document 2, a wave catching portion 115 is formed in a fan shape when seen from the windshield glass side (not shown), of the watch exterior 100, which is suitable for leading the standard wave incident from the windshield glass side to the magnetic core, but similarly to the related art shown in Patent Document 1, if the time display measure is provided at a top portion of the wave catching portion 115, it shields the standard wave and the wave catching portion 115 can not effectively receive the standard wave any more.

For the recent wrist-watch type radio controlled timepiece, more size reduction is in demand and the size reduction of the watch exterior has progressed. However, the time display measure is preferably bigger as long as time information is to be seen more easily. For example, if the time display measure is a hand-type analog-display dial plate, devices have been made to thicken the hands.

That is, the standard wave is getting more difficult to be received with size increase of the time display measure and the hands.

In addition, if the antenna end portion is too close to the metal exterior in the wrist watch constituted by the metal exterior, an eddy current loss is generated between the metal exterior and the antenna, which causes a situation of loss of antenna gain. Further, if the antenna is brought into contact with the metal exterior, the eddy current flows to the antenna and the entire metal exterior, and the antenna output is lowered. Thus, it is necessary that the antenna and the exterior should be separated by an appropriate distance.

Furthermore, since a loss is also generated inside of the antenna due to the eddy current and hysteresis loss, immoderate increase of the size of the antenna will enhance the influence of these resistance factors rather than the capability of collecting the magnetic flux, and the antenna gain will be lost to the contrary.

Besides, if self-inductance of the antenna is raised by size increase of the antenna, a self-resonant frequency of the antenna is lowered, and a frequency band that can be used as an antenna is narrowed.

As obvious from the explanation, with the related arts shown in Patent Document 1, Patent Document 2, the provision of the time display measure for notifying time, which is an essential purpose of a watch, more easily to be seen and the receiving of more standard wave can not coexist at the same time.

Therefore, a wrist-watch type radio controlled timepiece having solved such problems has been in a strong demand.

A technical object of the present invention is to solve such problems and to provide an antenna that can ensure a sufficient radio receiving level and a radio-wave receiving device equipped with the antenna. Particularly, the technical object of the present invention is to provide an antenna for radio controlled timepiece that can be housed in the wrist-watch type radio controlled timepiece for which small size and light weight are required, and the radio controlled timepiece provided with the antenna for radio controlled timepiece and an easy-to-see time display measure, which can ensure sufficient receiving level of the standard wave.

SUMMARY OF THE INVENTION

In order to achieve the objects described above, the following configuration is employed for an antenna of the present invention.

An antenna constituted by a columnar magnetic core and a coil portion winding a conductor around the magnetic core, is characterized by a extension portion in a flat-plate state extended from an end portion of the magnetic core; and a standing portion provided at least on one-direction face of the extension portion.

The configuration is characterized in that the extension portion is in contact with or is magnetically coupled with the magnetic core, or is formed as an integral body with the magnetic core.

The configuration is characterized in that an area of a flat-plate face of the extension portion is larger than an area of an end portion of the magnetic core.

The configuration is characterized in that the standing portion is in contact with or magnetically coupled with the extension portion, or is formed as an integral body with the extension portion.

The configuration is characterized in that the standing portion is provided at an end portion of the extended portion.

The configuration is characterized in that the standing portion is provided between a start end portion and the end portion of the extension portion.

The configuration is characterized in that the standing portion is provided in plural and separately from each other.

The configuration is characterized in that the extension portion is curved toward one direction side in the thickness directions of the extension portion.

The configuration is characterized in that the curving is made at a part of the extension portion.

The configuration is characterized in that the extension portion is extended from both end portions of the magnetic core and provided so that each extension portion is not overlapped with the other in the planar view.

The configuration is characterized in that at least two extension portions are extended from each end portion of the magnetic core, and provided so that the extension portions are not overlapped with extension portions extended from a different end portion in the planar view.

The configuration is characterized in that at least two extension portions extended from each portion of the magnetic core are provided separately in the thickness direction of the extension portion.

The configuration is characterized in that a magnetism-collecting member is provided in contact with or magnetically coupled with the standing portion or formed as an integral body with the standing portion.

The configuration is characterized in that the magnetism-collecting member is a flat-plate shape having a flat face opposed to the extension portion, and an area of the flat face of the magnetism-collecting member is larger than a sectional area of a joint portion between the standing portion and the magnetism-collecting member.

The configuration is characterized in that the magnetism-collecting member is disposed at least in one direction of a direction approaching from the standing portion to the magnetic core or a direction separating from the magnetic core.

The configuration is characterized in that a second standing portion is provided that is in contact with or magnetically coupled with the magnetism-collecting member or formed as an integral body with the magnetism-collecting member.

The configuration is characterized in that a fixing member that fixes the standing portion so as to be sandwiched by the extension portion and the magnetism-collecting member.

The configuration is characterized in that a screw mechanism in which the standing portion is arranged so as to be sandwiched by the extension portion and the magnetism-collecting member, and the extension portion, the standing portion, and the magnetism-collecting member are attached.

The configuration is characterized in that the standing portion has a concave shape, a convex shape, a notched shape, or a combination thereof, and is in contact with or magnetically coupled with the extension portion or the magnetism-collecting member.

The configuration is characterized in that the antenna is arranged inside a radio-wave receiving device for receiving a radio wave having information.

Further, the radio-wave receiving device with the antenna of the present invention equipped employs the configuration shown below.

The configuration is characterized in that the antenna is provided within an exterior partially formed by a non-conductor.

The configuration is characterized in that a circuit board required for an operation of the radio-wave receiving device is provided, and the circuit board is provided between a plurality of extension portions extended from an end portion of the magnetic core and arranged so as not to overlap both of the extension portions extended from a different end portion of the magnetic core in the planar view.

The configuration is characterized in that an anti-magnetic plate shielding a magnetic field is provided and the anti-magnetic plate is arranged so as to overlap the extension portion in the planar view.

The configuration is characterized in that the anti-magnetic plate shielding a magnetic field is provided and arranged so as not to overlap both of the extension portions extended from a different end portion of the magnetic core in the planar view.

The configuration is characterized by having at least one member in the extension portion, standing portion, magnetism-collecting member and a second standing portion, wherein the entire member is arranged overlapping a portion being a non-conductor of the exterior in the planar view.

The configuration is characterized by having the exterior of the radio-wave receiving device composed of a back lid and a watch case fitted with the back lid as well as a windshield glass; and being a radio controlled timepiece provided with a dial plate or a time display measure.

The configuration is characterized in that the standing portion or the second standing portion penetrates the dial plate or the time display measure so as to constitute an index member.

According to the present invention, a flat-plate state extension portion is extended at an end portion of a magnetic core around which a coil is wound, and a standing portion is provided on at least one-direction face of the extension portion.

By providing such configuration, even if there is a shielding object in an incoming direction of a radio wave, much more magnetic flux entering from a portion made of a non-conductor in the exterior of the radio-wave receiving device provided with the antenna can be collected, and the receiving sensitivity of the antenna can be increased.

Further, after the antenna body, the extension portion, and the standing portion are manufactured as separate bodies, they can be connected to each other, and even if the antenna of the present invention is equipped on a wrist-watch type radio controlled timepiece, for example, it can be housed in a limited space in the radio controlled timepiece, and an antenna with excellent receiving sensitivity can be constituted without reducing the size of the time display measure.

As a result, great contribution can be made to the size reduction of the radio controlled timepiece and the improvement in accuracy of the time display function, which is greatly helpful in its spread.

BEST MODE FOR CARRYING OUT THE INVENTION

An antenna of the present invention is provided with a columnar magnetic core formed by a ferromagnetic body, a coil portion wound around the magnetic core, a flat-plate state extension portion extended from an end portion of the magnetic core, and a standing portion provided at least at one-direction face of the extension portion. The one-direction face is any extension in the thickness direction of the extension portion.

The extension portion is larger the better and may be in a shape curved toward any extension in the thickness direction of the extension portion.

The extension portion and the standing portion are made of a ferromagnetic body and are not overlapped with the coil wound around the magnetic core in the planar view. The magnetic core, the extension portion, and the standing portion may be constituted integrally or constituted separately and connected as long as they are magnetically coupled.

With such configuration, particularly, even if the antenna is housed in the metal exterior, much more magnetic flux can be led to the magnetic core, and a radio-wave receiving device that can obtain high sensitivity can be provided.

EXAMPLE 1

Figure 1:
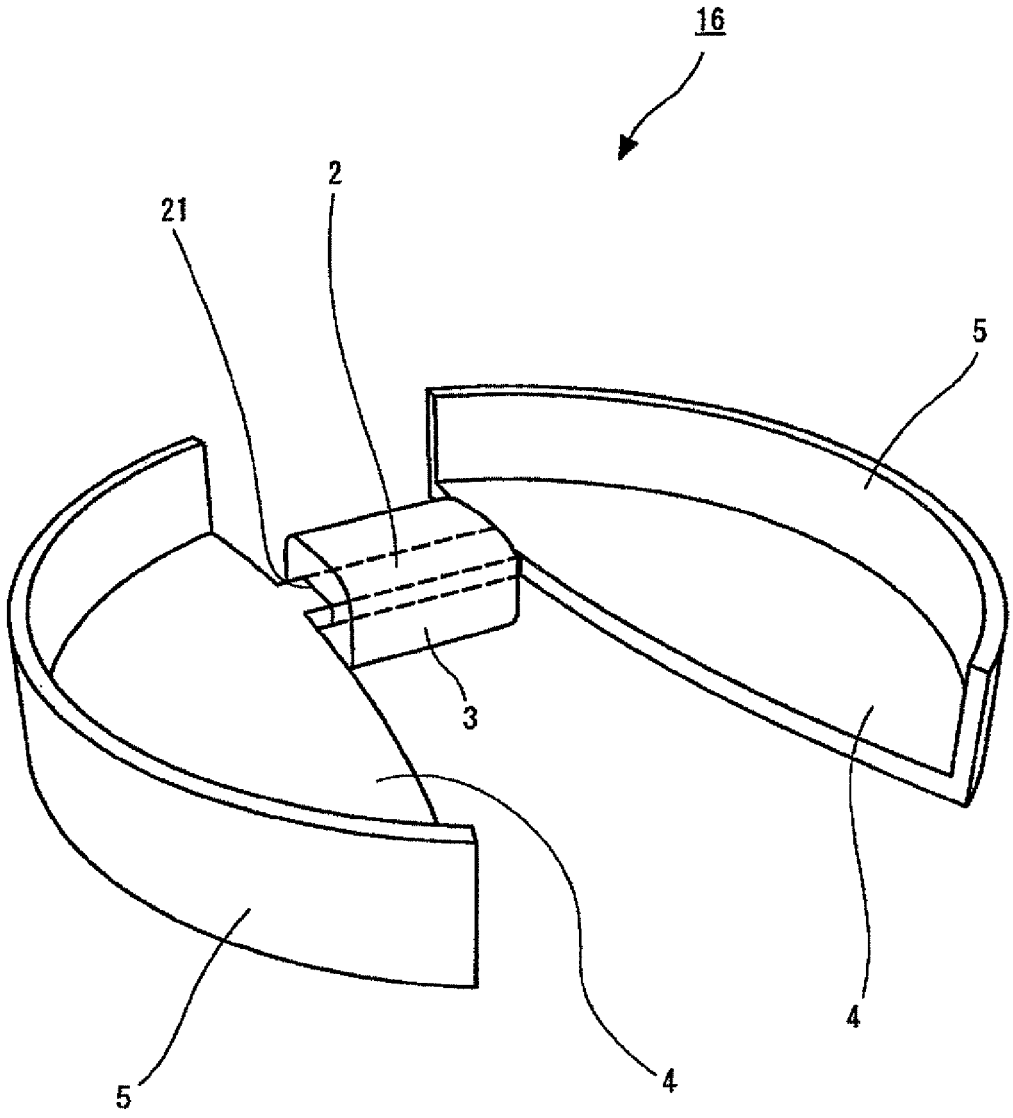
FIG. 1 is a perspective view depicting a structure of an antenna in a first embodiment of a radio controlled timepiece provided with an antenna of the present invention.
Figure 2:
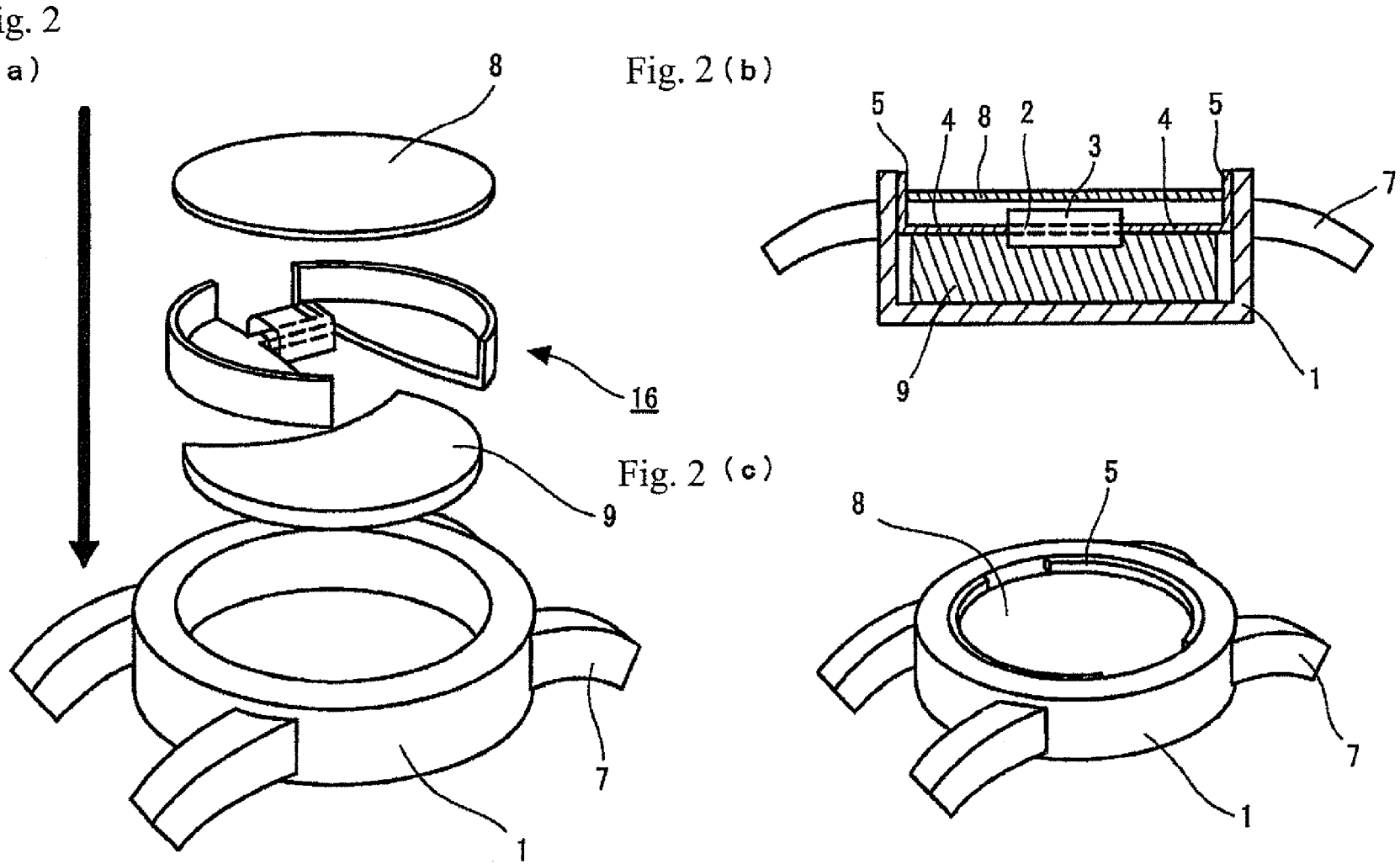
FIGS. 2(*a*)-(*c*) are a series of drawings depicting a structure in the first embodiment of the radio controlled timepiece provided with an antenna of the present invention.
Figure 3:
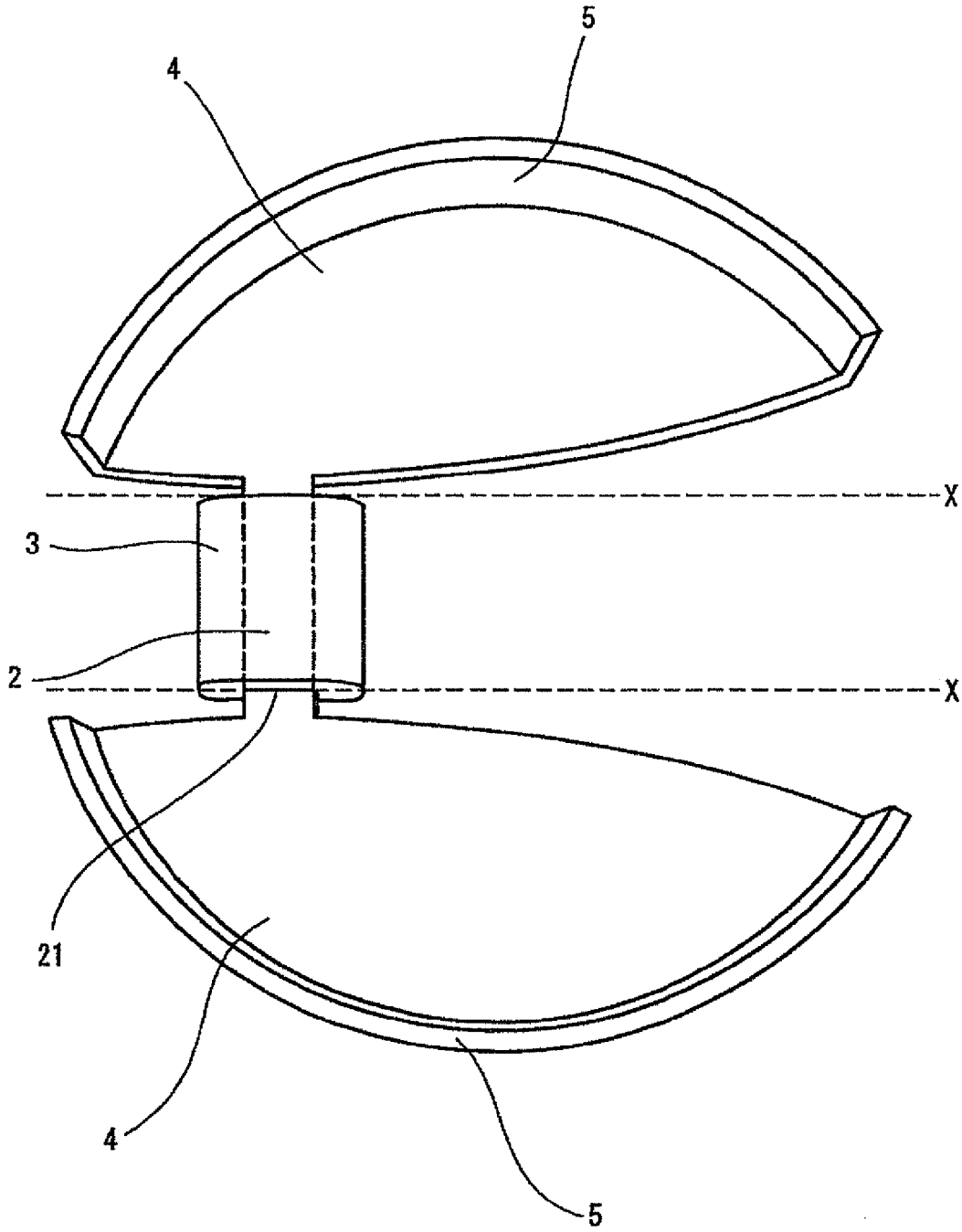
FIG. 3 is a perspective view depicting an appropriate size of an extension portion in the first embodiment of the radio controlled timepiece provided with an antenna of the present invention.

[Explanation of Antenna: FIGS. 1, 2, and 3]

A first embodiment of a radio controlled timepiece provided with an antenna of the present invention will be explained below as an example of a radio-wave receiving device provided with an antenna of the present invention using the attached drawings, FIG. 1 illustrates a shape of the antenna in the present invention and FIG. 2 for its housing into the radio controlled timepiece.

In FIG. 1, reference numeral 2 denotes a magnetic core, 3 for a coil wound in the longitudinal direction of the magnetic core 2, 4 for an extension portion, 5 for a standing portion, 16 for an antenna and 21 for an end portion of the magnetic core. The coil 3 actually has a thin wire wound around the magnetic core 2 in order, but for ease of understanding, it is shown cylindrically.

In FIG. 2, reference numeral 1 denotes a watch exterior, 8 for a time display measure such as a dial plate, a liquid crystal display device and the like, 7 for a band retaining portion at which a band (not shown), is locked, and 9 for a watch movement.

The antenna 16 has the magnetic core 2, the extension portion 4 not overlapping the coil 3 wound on the magnetic core 2 in the planar view, and the standing portion 5 provided at the extension portion 4. In the example shown in FIG. 1, the extension portion 4 is provided at both ends of the magnetic core 2.

The extension portion 4 is made of a ferromagnetic body and is not particularly limited as long as it is magnetically coupled with the magnetic core, and they may be constituted integrally. The shape of the extension portion 4 is larger the better, and such a shape that is housed within an inner wall of the watch exterior, which will be described later, without a gap as much as possible is preferable to an extent that an eddy current loss is not generated between the watch exterior and the antenna.

The standing portion 5 is shown in an example in which it is constituted toward the upper direction in the figure in FIG. 1. The standing portion 5 is also made of a ferromagnetic body and is not particularly limited as long as it is magnetically coupled with the extension portion 4, and they may be constituted integrally.

A material constituting the extension portion 4 and the standing portion 5 is not particularly limited, and a non-conductor is preferable in order to reduce the loss caused by the eddy current. However, in view of the problems of strength, manufacturing method, and the like, a conductor such as amorphous might be used. In that case, if metal is used as a material for the watch exterior 1, it is needless to say that the extension portion 4 and the standing portion 5 should not contact or electrically communicate with the watch exterior 1.

In FIG. 2, FIG. 2(*a*) is a cubic diagram schematically illustrating the equipping of the time display measure 8, the antenna 16, and the watch movement 9 on the watch exterior 1. An arrow schematically shows a direction in which each element is incorporated in the watch exterior 1. FIG. 2(*b*) is an end face diagram schematically illustrating a state where the radio controlled timepiece provided with an antenna of the present invention is seen from the direction of 3 o'clock or the direction of 9 o'clock. FIG. 2(*c*) is a cubic diagram schematically illustrating a state where the time display measure 8, the antenna 16, and the watch movement 9 have been equipped on the watch exterior 1

As shown in FIGS. 2(*a*) and 2(*b*), the antenna 16 is provided at the upper part of the watch movement 9, that is, on the side of the windshield glass (not shown), and the time display measure 8 is provided on its upper part. The extension portion 4 is overlapped with the time display measure 8 oppositely, while the standing portion 5 is placed upright on the side of the windshield glass (not shown) between the time display measure 8 and the inner wall of the watch exterior 1, and its height is between the time display measure 8 and the inner wall of the watch exterior 1 so that the standing portion 5 is seen when the radio controlled timepiece provided with an antenna of the present invention is seen diagonally from the side of the windshield glass (not shown).

With such configuration, even if the watch exterior 1 is metal, the standard wave coming from the side of the windshield glass (not shown) can be received by the standing portion 5 and led to the magnetic core 2. If the time display measure 8 is a dial plate, for example, by reducing its thickness, the standard wave can also be received by the extension portion 4, and the extension portion 4 can also lead the standard wave received here to the magnetic core 2.

It is needless to say that since the standing portion is provided along the inner wall of the watch exterior 1, ease-to-watch of the time display measure 8 is not impaired or its esthetic appearance as a watch is not lost.

As mentioned above, if the extension portion 4 is made too big, an influence of the loss caused by the eddy current or hysteresis loss inside the antenna becomes larger than the magnetic-flux collecting capability, and the antenna gain is damaged. In addition, the self inductance of the antenna is raised, which lowers the self resonant frequency of the antenna and narrows a frequency band capable of being used for the antenna. Thus, the size of the extension portion 4 should be such that the antenna gain is not impaired.

Specifically, it is only necessary that the extension portion 4 is not placed inside virtual extension lines X of the end portions 21 of the magnetic core 2 shown in FIG. 3. The inside of the virtual extension lines X is the side where one virtual extension line X and the other virtual extension line X are opposed to each other.

Even if the extension portion 4 is provided inside the virtual extension lines X, the magnetic flux received inside the virtual extension lines X is rarely led to the magnetic core 2, and by the increase in the influence of resistance factors with size increase of the antenna, the antenna gain is conversely impaired.

Figure 4:
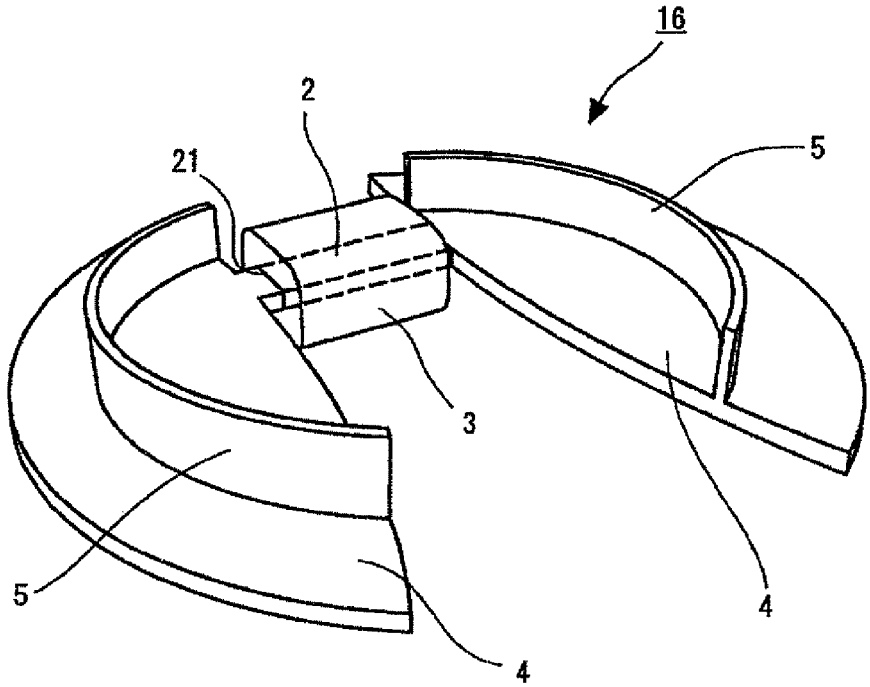
FIGS. 4(*a*) and (*b*) depict another example of a shape of a standing portion in the first embodiment of the radio controlled timepiece provided with an antenna of the present invention.
Figure 4:
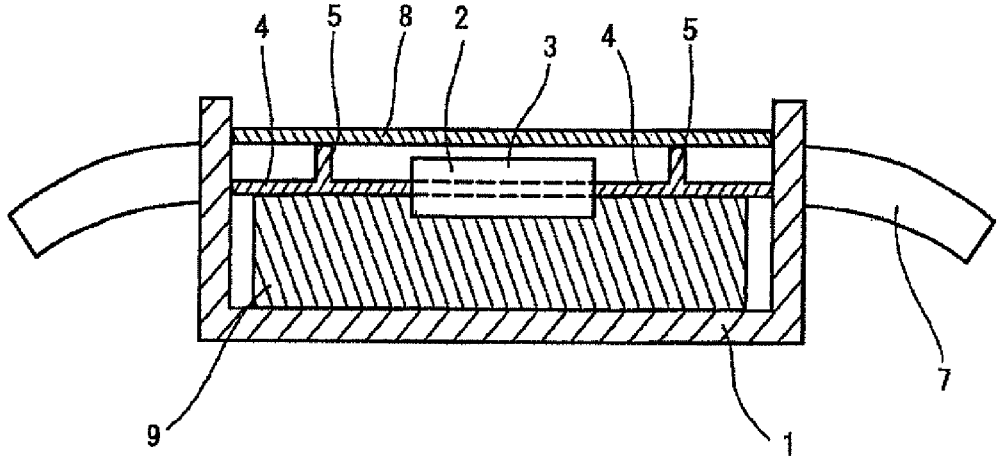
Figure 5:
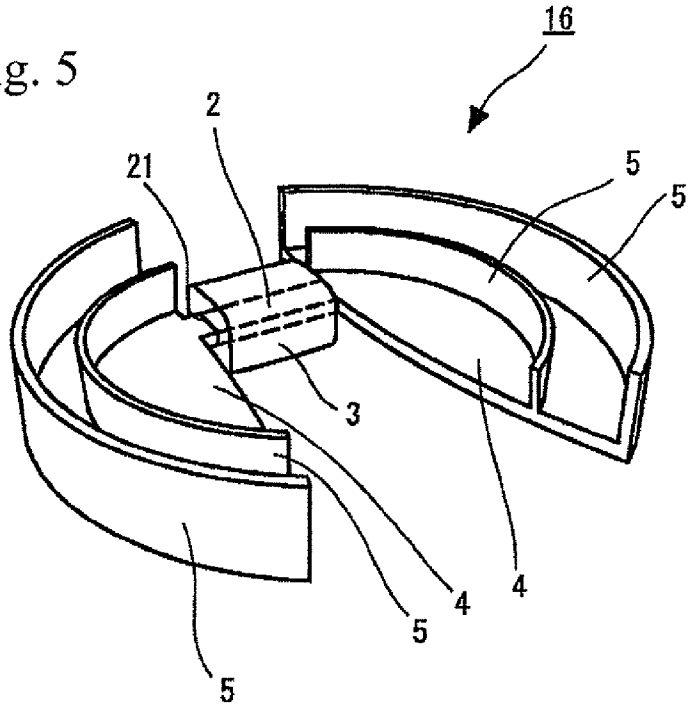
FIGS. 5(*a*)-(*c*) still another example of the shape of the standing portion in the first embodiment of the radio controlled timepiece provided with an antenna of the present invention.
Figure 5:
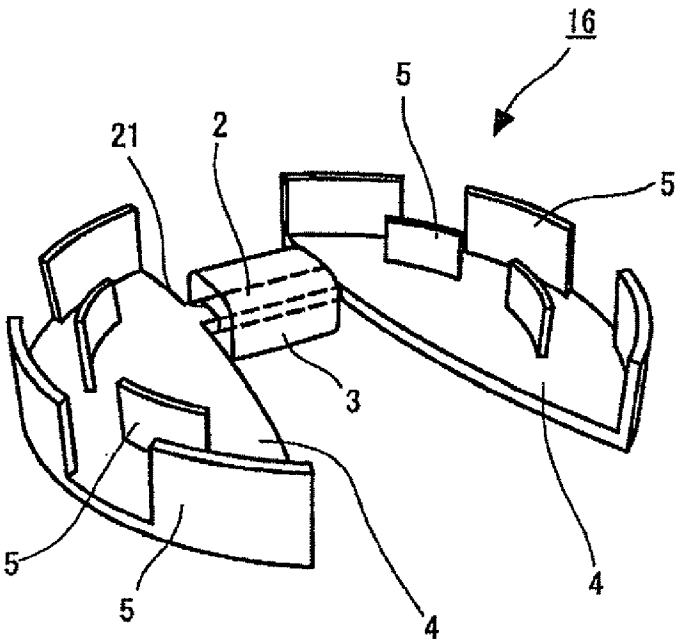
Figure 5:
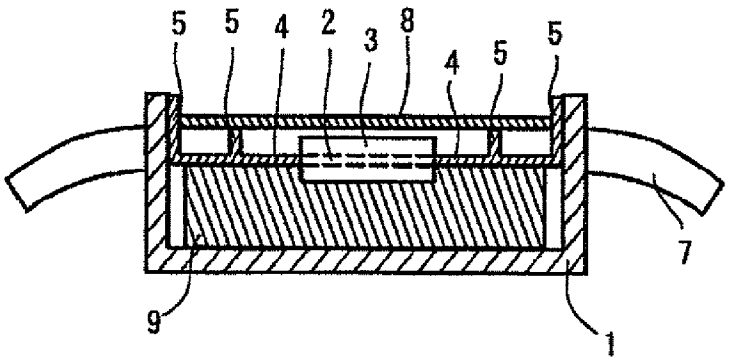
Figure 6:
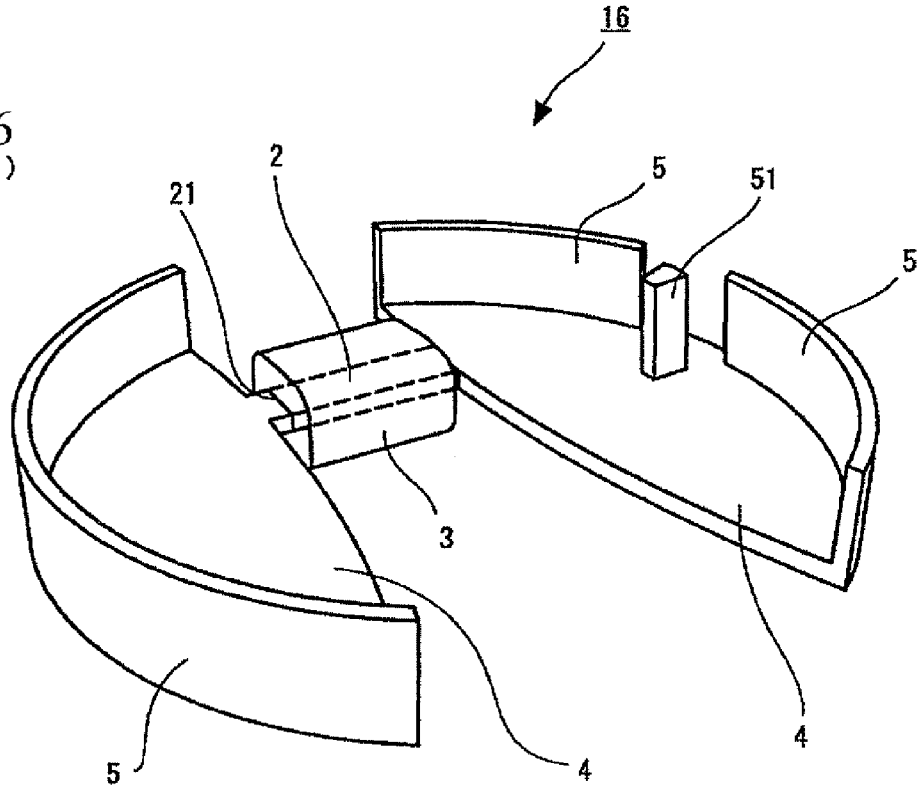
FIGS. 6(*a*) and (*b*) depict still another example of the shape of the standing portion in the first embodiment of the radio controlled timepiece provided with an antenna of the present invention.
Figure 6:
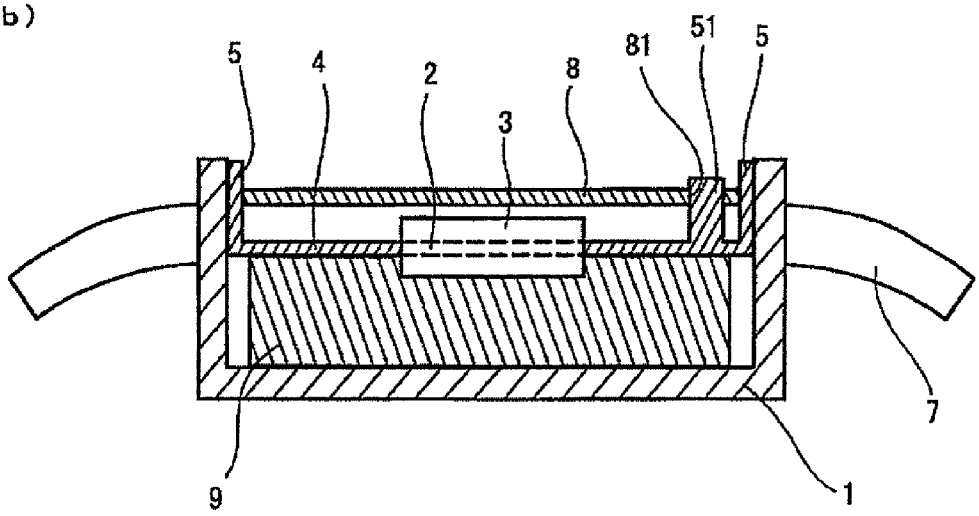

[Explanation 1 of Antenna Shape: FIGS. 4, 5, and 6]

Note that, FIGS. 1 and 2 show an example in which the standing portion 5 is provided at the end portion of the extension portion 4, but not limited to that. FIG. 4 shows an example where the standing portion 5 is provided between the start end portion and the end portion of the extension portion 4. FIG. 5 shows an example in which a plurality of standing portions 5 are provided separately at the extension portion 4. FIG. 6 shows an example in which the standing portion 5 is fitted in a slit or hole portion of the time display measure 8.

In each figure, (a) is a cubic diagram of schematic illustration and (b) is an end face diagram schematically showing a state where the radio controlled timepiece provided with an antenna of the present invention is seen from the direction of 3 o'clock or the direction of 9 o'clock. The same reference numerals are given to the configuration already explained.

In FIG. 4, the standing portion 5 is provided between the start end portion and the end portion of the extension portion 4. The standing portion 5 has a role to collect the magnetic flux flowing in parallel with the time display measure (dial plate, for example) and to have it flow into the extension portion. Thus, even though the standing portion 5 is not arranged between the time display measure 8 and the inner wall of the watch exterior 1, the standard wave transmitted through the time display measure can be received by the standing portion 5.

With such configuration, since the standing portion 5 is fully covered by the time display measure 8, the configuration can also be applied to the radio controlled timepiece with the same design as conventional designs.

In addition, as shown in FIG. 5, by providing the plurality of standing portions separately, more of the magnetic flux flowing in parallel with the time display measure can be received, and the receiving sensitivity can be increased. Note that, a slit is provided in the standing portion 5, here, but the slit does not have to be provided, and as shown in FIG. 5*c*, the standing portions 5 may be provided in a double structure, and the like.

Further, in FIG. 5, the heights of the standing portions 5 are not uniform, but not limited to that. The height can be set as appropriate, considering the number of the standing portions to be provided and a space inside the exterior of the radio controlled timepiece.

Furthermore, as shown in FIG. 6, a hole portion 81 may be provided at the time display measure 8 and a standing portion 51 to be provided at the extension portion 4 may be fitted therein. With this arrangement, if the time display measure 8 is a dial plate, for example, the standing portion 51 may be used as an index member (so-called hour hand).

With such configuration, the standing portion 51 is integrated with the time display measure 8, which widens the options of the design, and similarly to a case where the standing portion 5 is arranged between the time display measure 8 and the inner wall of the time exterior 1, the standing portion 51 can receive much more magnetic flux, by which the receiving sensitivity of the antenna can be increased.

Even in this configuration, too, the shape and number of the standing portions 51 may be set as appropriate, considering the shape of the exterior of the radio controlled timepiece.

Figure 7:
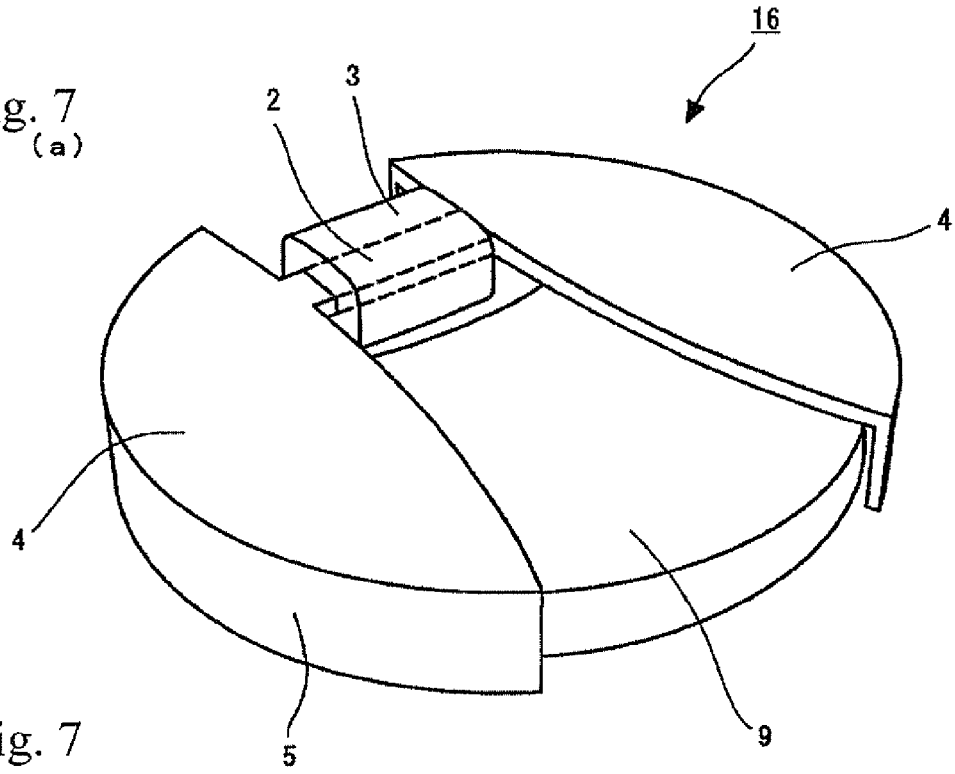
FIGS. 7(*a*) and (*b*) another example of the shape of the antenna in the first embodiment of the radio controlled timepiece provided with an antenna of the present invention.
Figure 7:
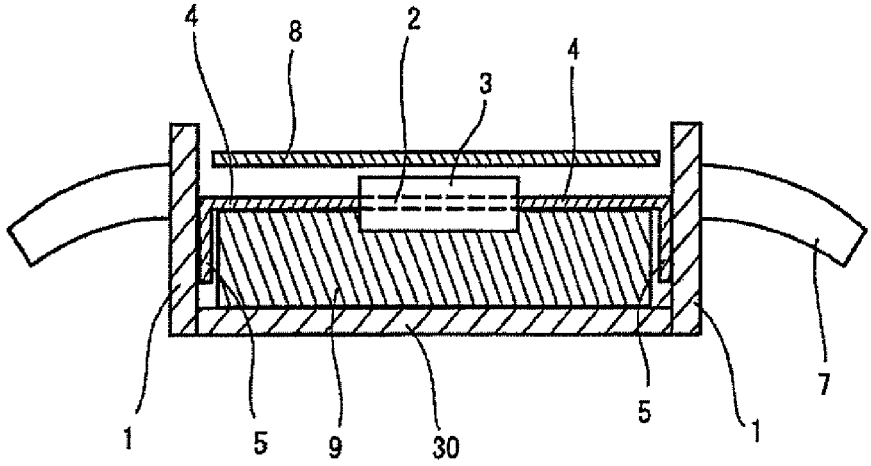
Figure 8:
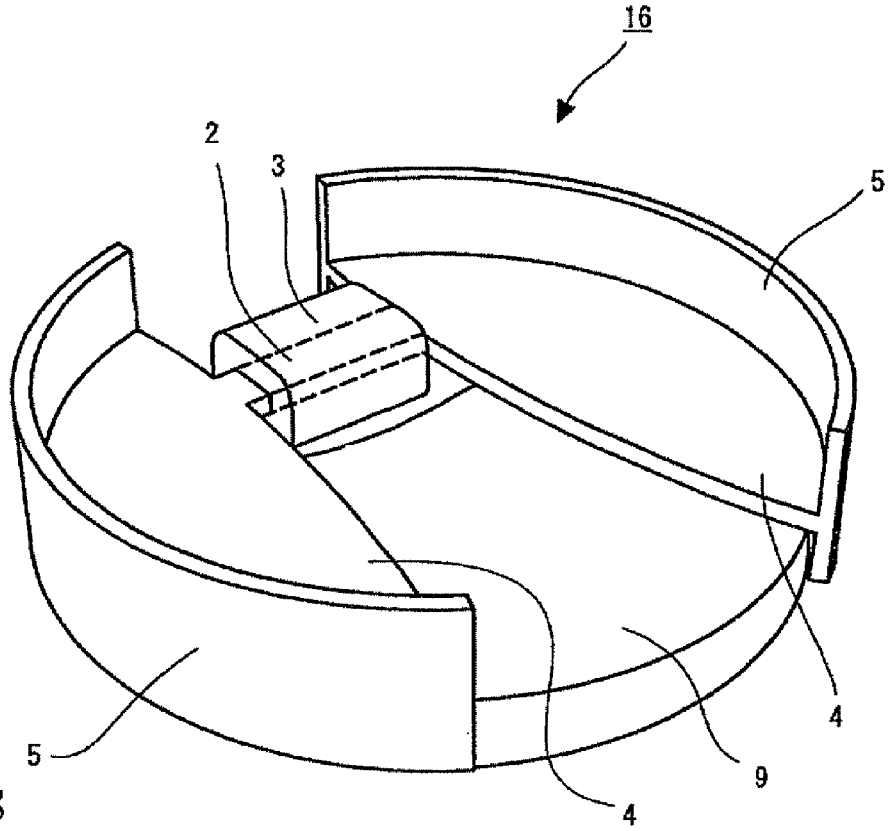
FIGS. 8(*a*) and (*b*) depict still another example of the shape of the antenna in the first embodiment of the radio controlled timepiece provided with an antenna of the present invention.
Figure 8:
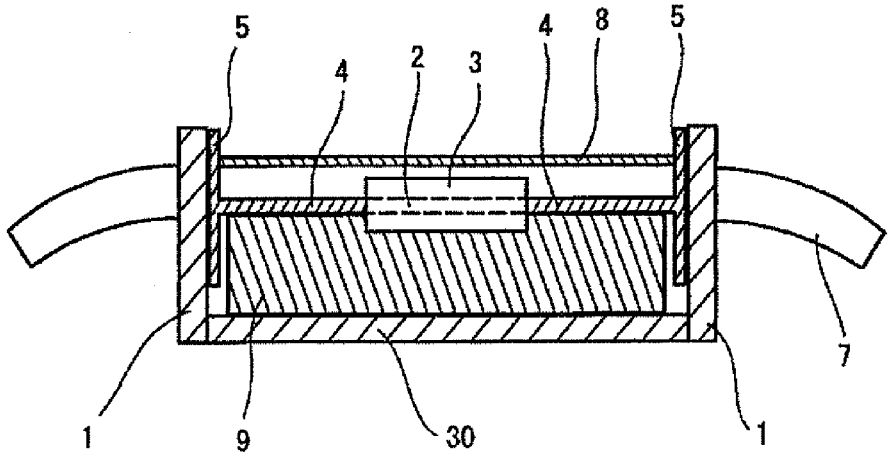

[Explanation 2 of Antenna Shape: FIGS. 7 and 8]

The shape of the standing portion 5 of the antenna 16 is, as shown in FIGS. 1 to 6, not limited to the shape to be placed upright on the side of the windshield glass (not shown). FIG. 7 shows an example in which the standing portion 5 is placed upright on the back side of the radio controlled timepiece and an example in which the standing portion 5 is placed upright on the side for watch and on the back lid side.

In each figure, (a) is a cubic diagram of schematic illustration and (b) is an end face diagram schematically showing a state where the radio controlled timepiece of the present invention is seen from the direction of 3 o'clock or the direction of 9 o'clock. In FIGS. 7 and 8, reference numeral 30 denotes a back lid. The same reference numerals are given to the configuration already explained.

Provided with such a shape, the standard wave coming from the side face of the watch exterior 1 or the back lid 30 side can also be received.

The radio controlled timepiece might be removed from the wrist and left on a desk or the like, for example, other than a situation that it is worn by a human. Considering such use situation of the radio controlled timepiece, by making the standing portion 5 that is a portion for receiving the wave bigger and directing it to a plurality of directions, the direction and area for receiving the wave increase, and the standard wave may be received more than that in the conventional one.

It has been already explained that the constitution of the entire watch exterior 1 by metal improves texture and the like of the watch. Even in that case, the standard wave can be received, even though slightly, through a rubber packing (not shown), provided at a connection portion between the watch exterior 1 and a winder or switch measure (not shown), or through rubber seal member (not shown), provided at a fitting portion between the back lid 30 and the watch exterior 1, and the like, and therefore, a portion receiving the wave may be preferably enlarged as mentioned above.

In addition, a part of the watch exterior 1 or the back lid 30 might be formed by a resin. In such a case, since the standard wave comes through the part of the watch exterior 1 as well as the back lid 30, by enlarging the portion receiving the wave, much more magnetic flux can be led to the antenna, which is effective.

EXAMPLE 2

Figure 9:
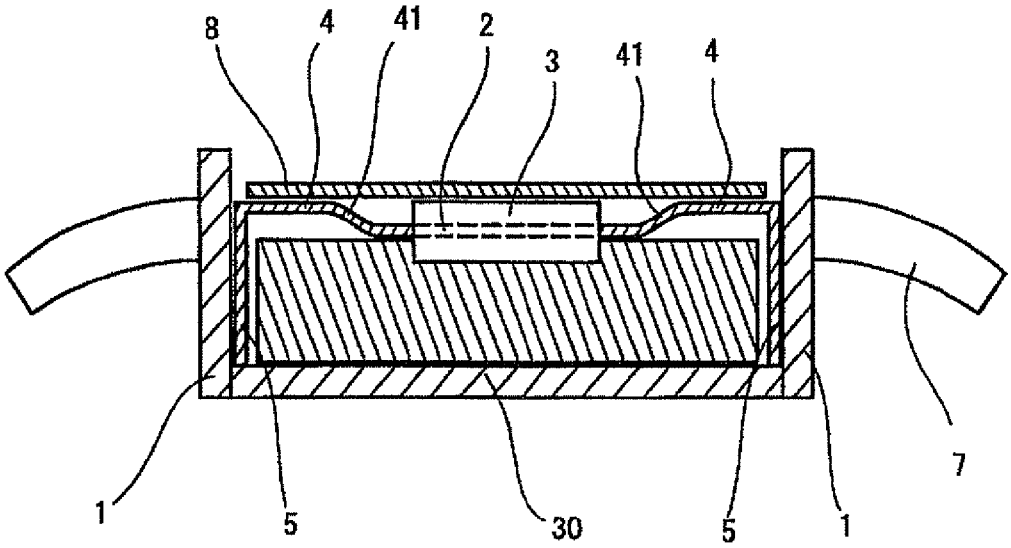
FIGS. 9(*a*) and (*b*) a structure in a second embodiment of the radio controlled timepiece provided with an antenna of the present invention.
Figure 9:
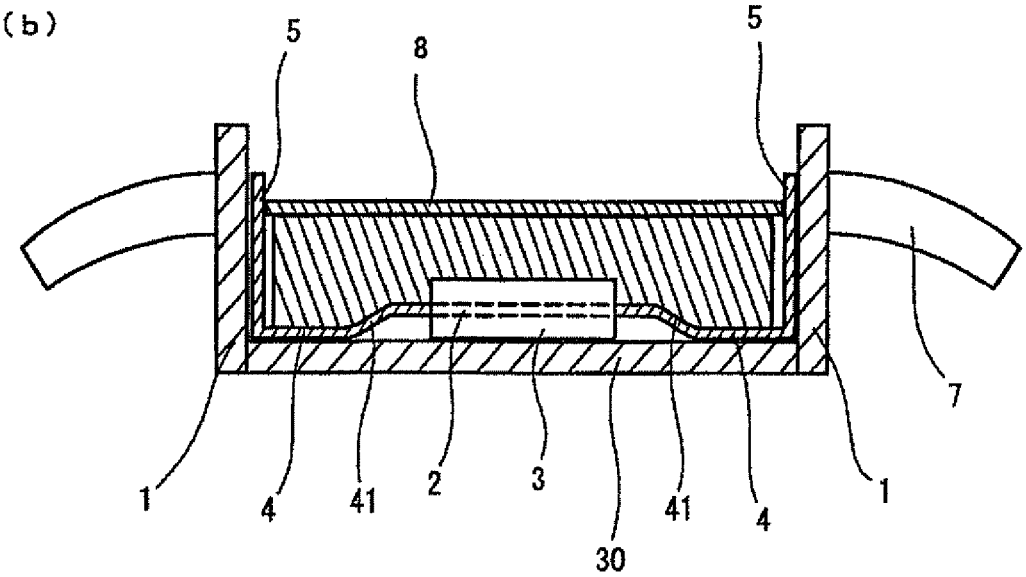

[Explanation of Antenna Structure and Arrangement: FIG. 9]

Next, a second embodiment of the radio controlled timepiece provided with an antenna of the present invention will be explained. FIG. 9 explains the shape of the extension portion of the antenna in the present invention, and shows an end face diagram schematically showing a state where the radio controlled timepiece provided with the antenna of the present invention is seen from the direction of 3 o'clock or the direction of 9 o'clock.

In FIG. 9, reference numeral 41 denotes a curved portion provided at the extension portion 4. The same reference numerals are given to the configuration already explained. FIG. 9(*a*) shows the configuration in which the extension portion 4 is brought closer toward the time display measure 8 by the curved portion 41. FIG. 9(*b*) shows the configuration in which the antenna 16 itself is arranged closer to the back lid 30 side rather than the watch movement 9 side and the extension portion 4 is brought closer toward the back lid 30 by the curved portion 41.

If the time display measure 8 is a dial plate, for example, it is a portion considered as a "face" of the watch, and its thickness or material should not be freely selected for the receiving of the standard wave, but by bringing the extension portion 4 closer to the time display measure 8 by the curved portion 41, more standard wave can be received.

Further, since the back lid 30 is a portion of the direct contact between a human body and a watch, it might be formed by resin or partially by rubber according to the specification required by the watch. In such watch specification, by bringing the extension portion 4 closer to the back lid 30 by the curved portion 41, the standard wave coming from the direction of the back lid 30 can be led to the magnetic core 2.

Of course, even though the entire watch exterior 1 is formed by metal, since the standard wave can be received, though slightly, through the rubber seal material and the like (not shown), provided at the fitting portion between the back lid 30 and the watch exterior 1, as mentioned above, bringing the extension portion 4 closer to the back lid 30 is effective.

EXAMPLE 3

Figure 10:
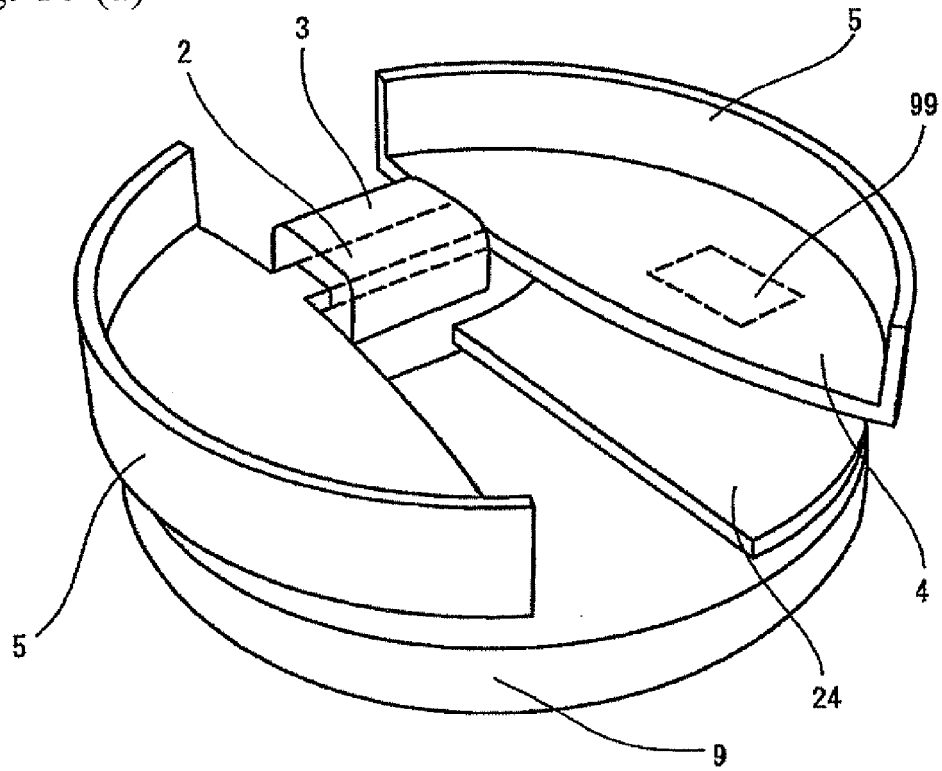
FIGS. 10(*a*) and (*b*) a structure in a third embodiment of the radio controlled timepiece provided with an antenna of the present invention.
Figure 10:
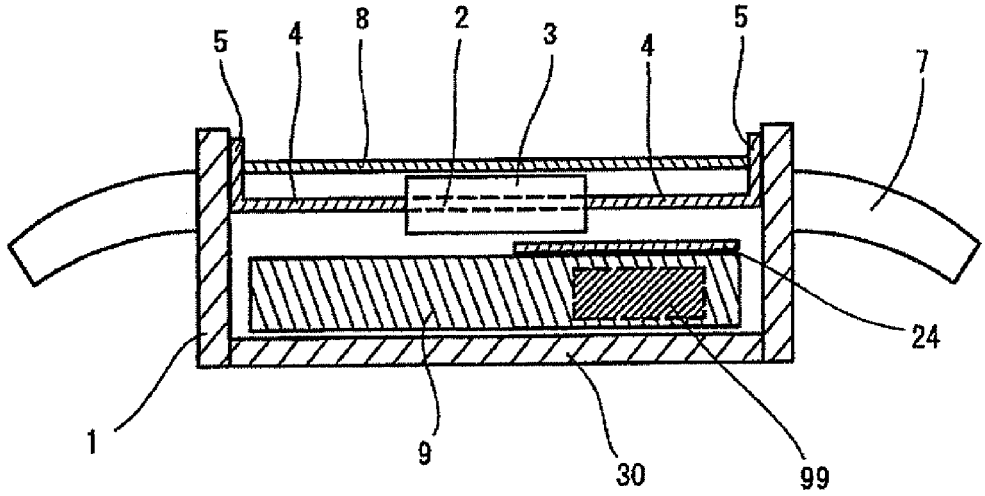
Figure 11:
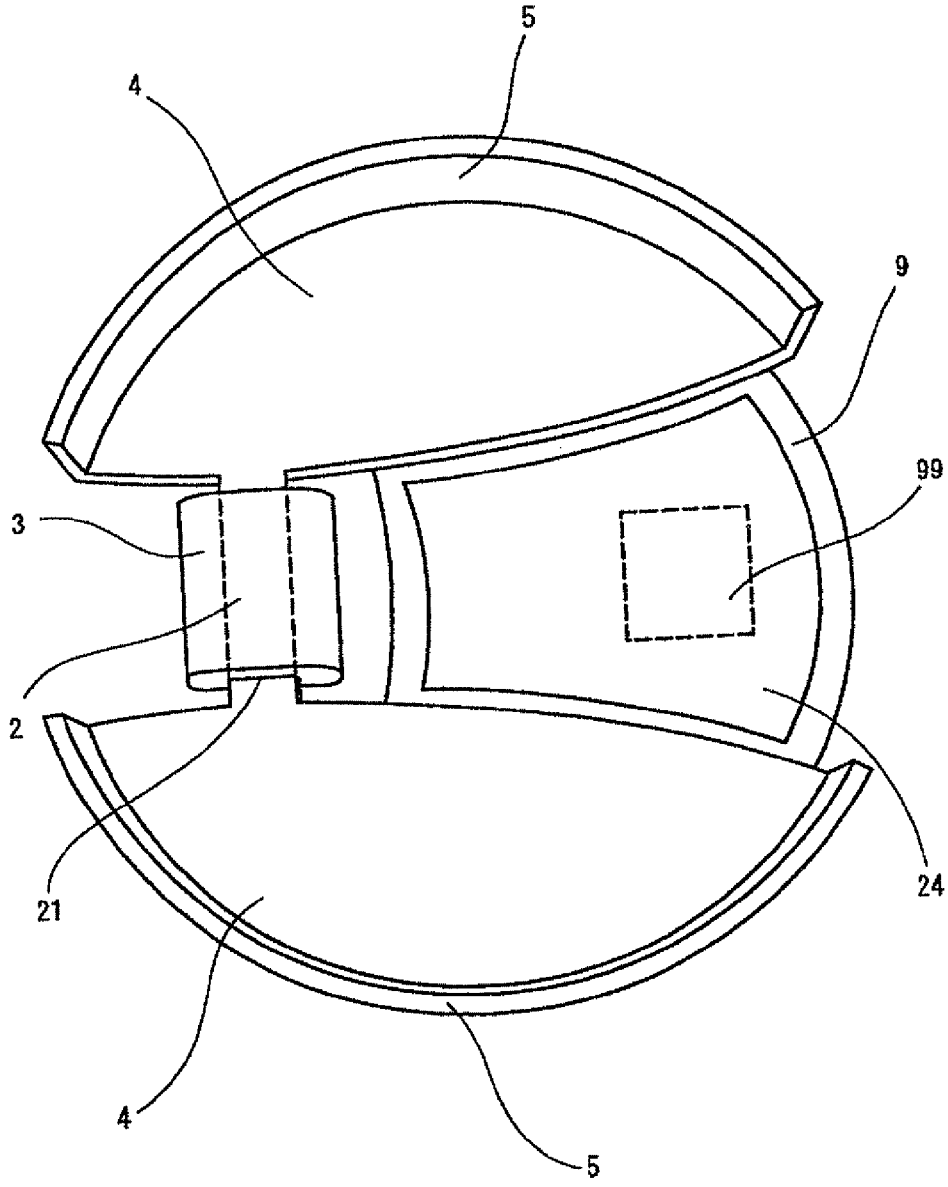
FIG. 11 is a perspective view depicting a structure of an anti-magnetic plate in the third embodiment of the radio controlled timepiece provided with an antenna of the present invention.

[Explanation of Structure of Anti-magnetic Plate: FIGS. 10 and 11]

Next, a third embodiment of the radio controlled timepiece provided with an antenna of the present invention will be described using FIGS. 10 and 11. FIG. 10(*a*) is a cubic diagram for explaining a positional relation among the antenna, the watch movement, and the anti-magnetic plate in the present invention, and FIG. 10(*b*) shows an end face diagram schematically showing a state where the radio controlled timepiece provided with the antenna of the present invention is seen from the direction of 3 o'clock or the direction of 9 o'clock. FIG. 11 is a plan diagram for explaining the shape of the anti-magnetic plate. In FIGS. 10 and 11, reference numeral 24 denotes the anti-magnetic plate and 99 for a motor for driving index. The same reference numerals are given to the configuration already explained.

The time display measure 8 is a dial plate, a liquid crystal display device and the like. In the radio controlled timepiece provided with an antenna of the present invention, a measure for notifying time may be a dial plate of analog index type, for example, a liquid crystal display device may be used. The watch movement 9 has different circuits and components according to the specification of the time display measure 8. If the time display measure 8 is a dial plate of analog index type, for example, the motor 99 for driving index is needed for driving the index.

In order to receive more standard wave, the radio controlled timepiece preferably has a structure in which the magnetic flux is not prevented from entering the inside of the watch exterior 1, but since the motor 99 for driving index also has a coil, the influence of the magnetic flux from the outside might affect an operation of the motor 99 for driving index. If the operation of the motor 99 for driving index for notifying time information is not correct, the watch can not tick accurately even though the standard wave is accurately received.

Therefore, the anti-magnetic plate 24 is provided between the watch movement 9 and the time display measure 8 so as to prevent the influence of the magnetic flux from the outside. It is particularly important that the anti-magnetic plate 24 covers the motor 99 for driving index. With such configuration, the magnetic flux flowing into the antenna 16 is not prevented by the anti-magnetic plate 24, but the watch movement 9 can have anti-magnetic properties.

In an example shown in FIG. 10, the anti-magnetic plate 24 is provided on an upper face of the watch movement 9 in a shape covering the motor 99 for driving index, but not limited to that, it may be such configuration that the side face of the watch movement 9 is also covered or that both the upper face and the side face are covered.

[Explanation of Overlapping of the Anti-magnetic Plate: FIG. 11]

In addition, as shown in FIG. 11, the extension portion 4 and the standing portion 5 provided thereon, and the anti-magnetic plate 24 provided between the portions and the watch movement 9 may be in a shape not overlapped in the planar view.

It is only necessary that the anti-magnetic plate 24 covers an upper part of the motor 99 for driving index, which is affected by the magnetic flux, and it is necessary for preventing the influence of the magnetic flux on the watch movement 9, but the receiving sensitivity of the antenna 16 might be lowered to the contrary depending on the arrangement.

That is, in the example shown in FIG. 11, the extension portion 4 is provided at both end portions 21 of the magnetic core 2, and in such configuration, the two extension portions 4 cover the upper part of the watch movement 9. If a single anti-magnetic plate 24 is overlapped below the two extension portions 4, the standard wave is received, and the magnetic flux flowing from the extension portion 4 provided at one end portion 21 of the magnetic core 2 flows out to the extension portion 4 provided at the other end portion 21 through the anti-magnetic plate 24, which is a ferromagnetic body, by which the receiving sensitivity of the wave is lowered.

In the example shown in FIG. 11, the anti-magnetic plate 24 covers the upper part of the motor 99 for driving index and is arranged so as not to overlap both the one extension portion 4 and the other extension portion 4, but of course, not limited to that. What is important is that the anti-magnetic plate 24 does not overlap either one of the two extension portions 4 extended from the different end portions in the planar view so as not to bridge the magnetic flux generated at the two extension portions 4 extended from the different end portions, and the plate may overlap the extension portion 4 extended from the same end portion.

The material or shape of the anti-magnetic plate 24 can be determined, naturally considering magnetic permeability and the like of the ferromagnetic body constituting the antenna 16 and a coil constant and the like of the motor 99 for driving index, but the anti-magnetic plate 24 should not prevent the flow of the magnetic flux generated at the extension portion 4 to the magnetic core 2.

EXAMPLE 4

Figure 12:
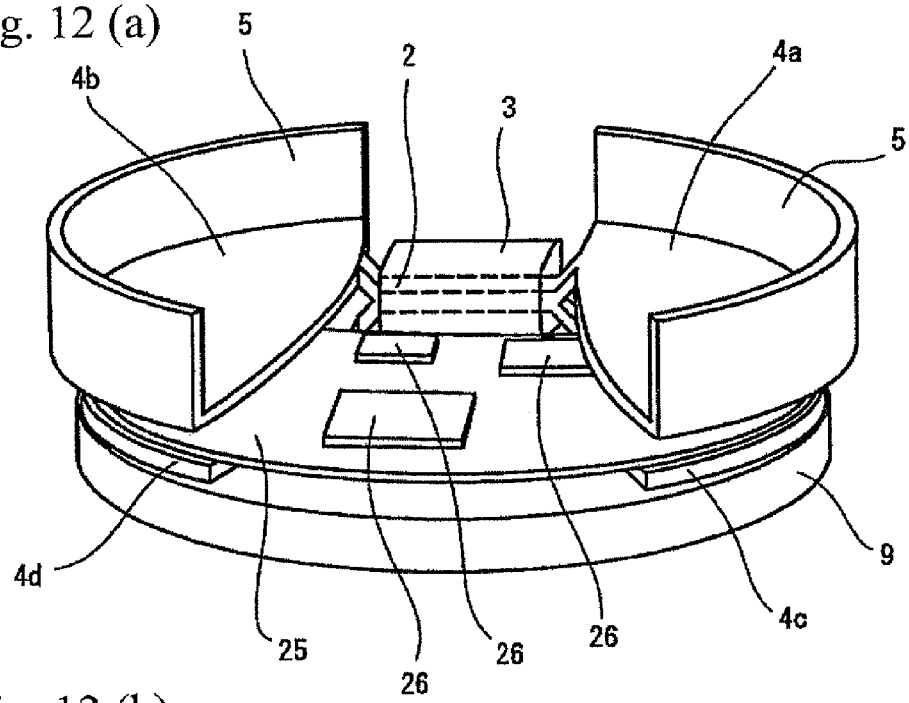
FIGS. 12(*a*) and (*b*) depict a structure in a fourth embodiment of the radio controlled timepiece provided with an antenna of the present invention.
Figure 12:
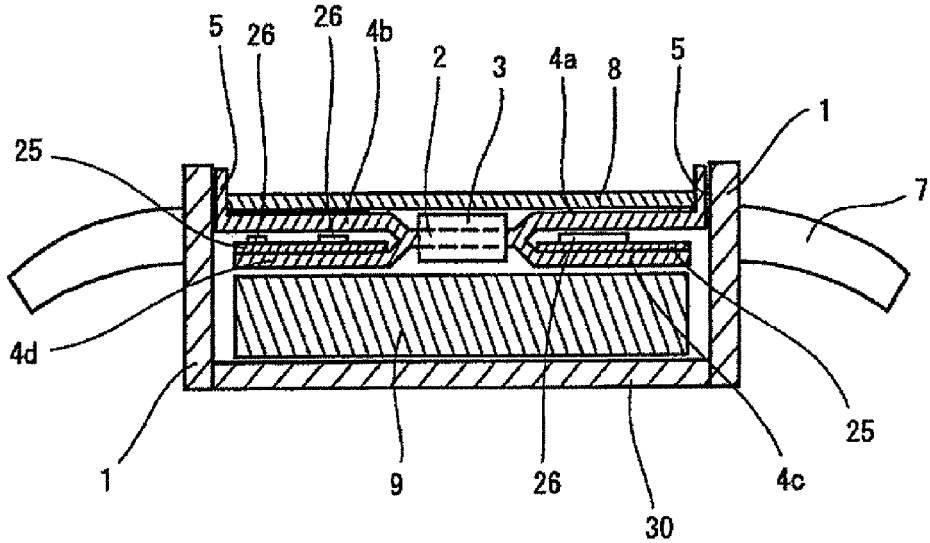

[Explanation of Shape of Extension Portion: FIG. 12]

Next, a fourth embodiment of the radio controlled timepiece provided with an antenna of the present invention will be explained using FIG. 12. FIG. 12(*a*) is a cubic diagram for explaining a positional relation between the antenna and the watch movement in the present invention, and FIG. 12(*b*) shows an end face diagram schematically showing a state where the radio controlled timepiece of the present invention is seen from the direction of 3 o'clock or the direction of 9 o'clock. In FIG. 12, two extension portions are provided at each end portion 21 of the magnetic core 2. Reference character 4*a* denotes a first extension portion, 4*b* for a second extension portion, 4*c* for a third extension portion, and 4*d* for a fourth extension portion. Reference numeral 25 is a circuit board included in the watch movement 9, and 26 is also an electronic component such as a circuit element and the like. The same reference numerals are given to the configuration already explained.

The fourth embodiment shown in FIG. 12 is for explaining configuration in which a dead space is not created inside the radio controlled timepiece even if the antenna is made bigger.

At each of the first extension portion 4*a* and the second extension portion 4*b*, the standing portion 5 is provided, and is placed upright in a direction of the time display measure 8. The third extension portion 4*c* is separated from the first extension portion 4*a* and provided opposite to that. Similarly, the fourth extension portion 4*d* is separated from the second extension portion 4*b* and provided oppositely.

Below the first extension portion 4*a* and the second extension portion 4*b* as well as the third extension portion 4*c* and the fourth extension portion 4*d*, the watch movement 9 is provided, and the circuit board 25 included in the watch movement 9 is provided between the first extension portion 4*a* and the third extension portion 4*c* as well as the second extension portion 4*b* and the fourth extension portion 4*d*.

There has a gap between the circuit board 25 included in is the watch movement 9 and the electronic component 26 equipped on the circuit board 25 so that they are not brought into contact with the respective extension portion.

That is, a-part of the components of the watch movement, 9 is provided between the extension portions. With such configuration, a dead space between the extension portions is eliminated, and a limited space in the watch exterior 1 can be effectively used.

In an example shown in FIG. 12, the standing portion 5 is not provided at the third extension portion 4*c* or the fourth extension portion 4*d*, but it is needless to say that the standing portion may be provided.

With such configuration, without generating a dead space inside the watch exterior 1, the magnetic flux can be collected from three directions of the side of the windshield glass (not shown), the side face of the watch exterior 1, and the back lid 30. Further, since the circuit board 25 is covered by the extension portion, magnetic protection is realized, which can prevent the malfunction caused by a magnetic influence on the electronic component 26, and since much more magnetic flux can be collected by the magnetic core 2, the receiving sensitivity of the wave can be increased.

EXAMPLE 5

Figure 13:
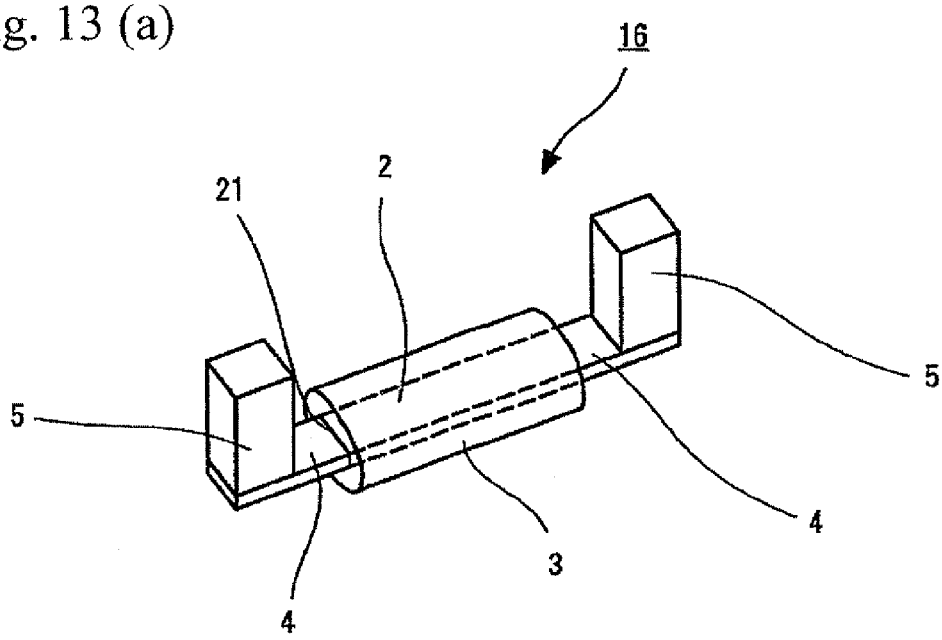
FIGS. 13(*a*) and (*b*) a structure and arrangement of an antenna in a fifth embodiment of the radio controlled timepiece provided with an antenna of the present invention.
Figure 13:
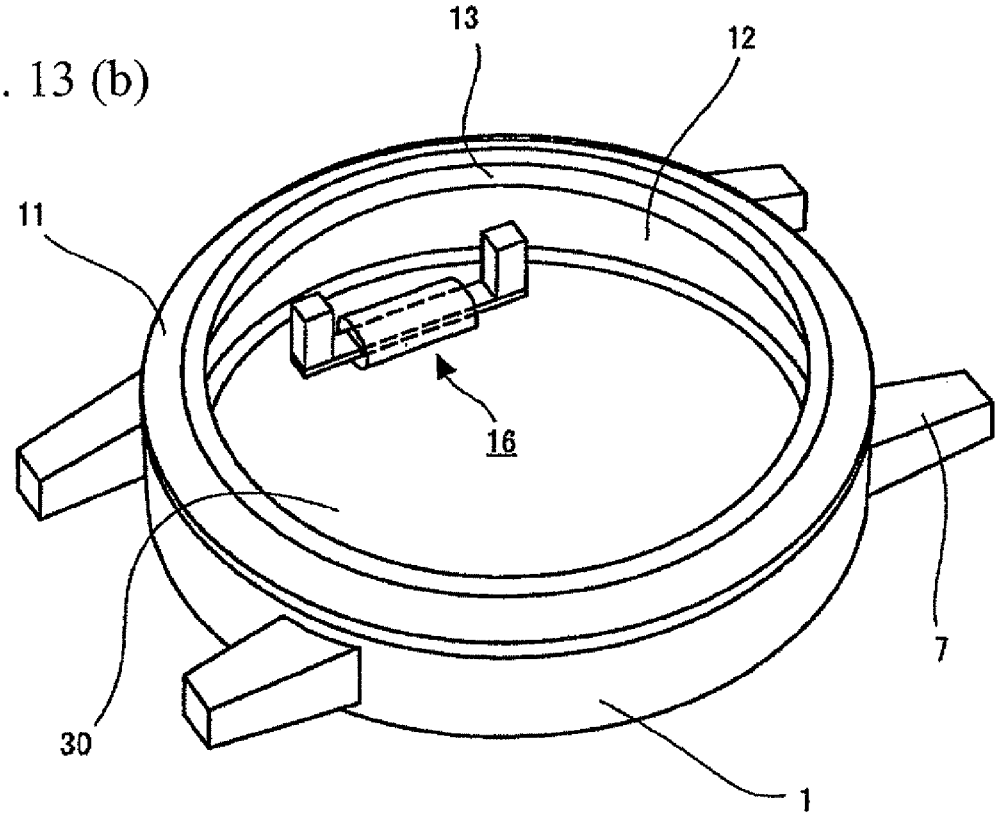
Figure 14:
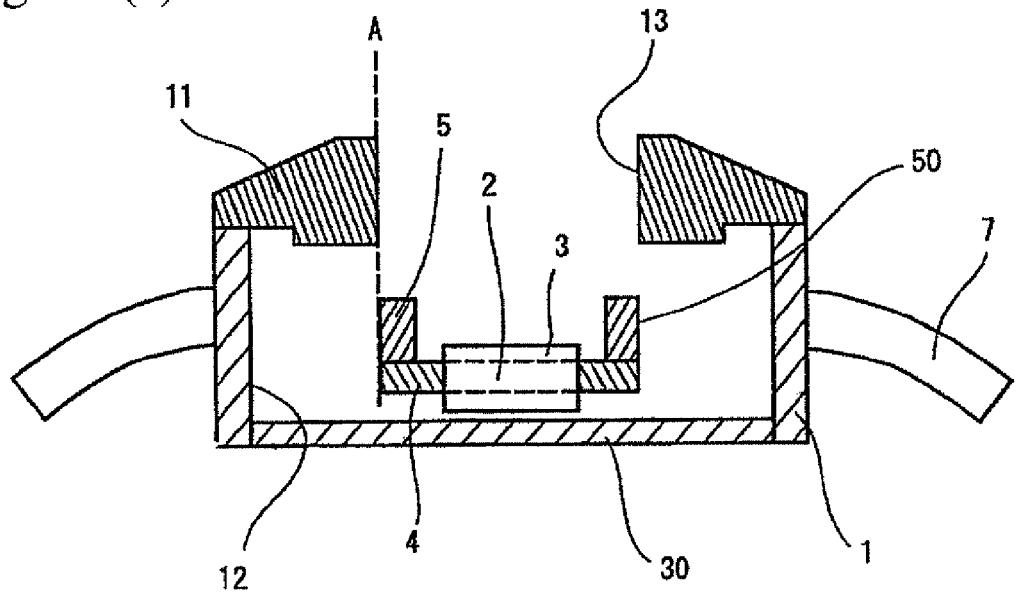
FIGS. 14(*a*) and (*b*) depict positions of the antenna and a watch exterior in the fifth embodiment of the radio controlled timepiece provided with an antenna of the present invention.
Figure 14:
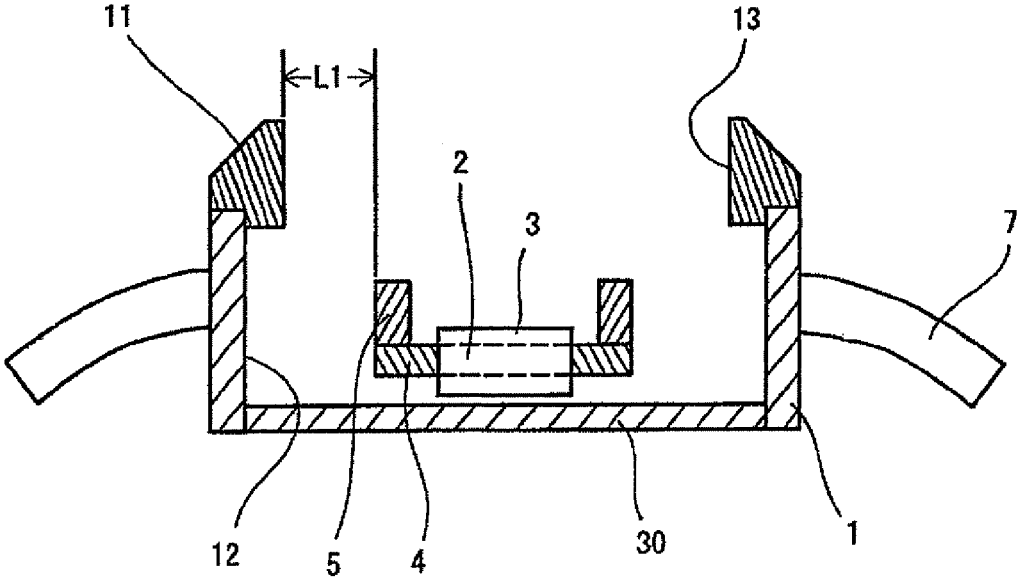
Figure 15:
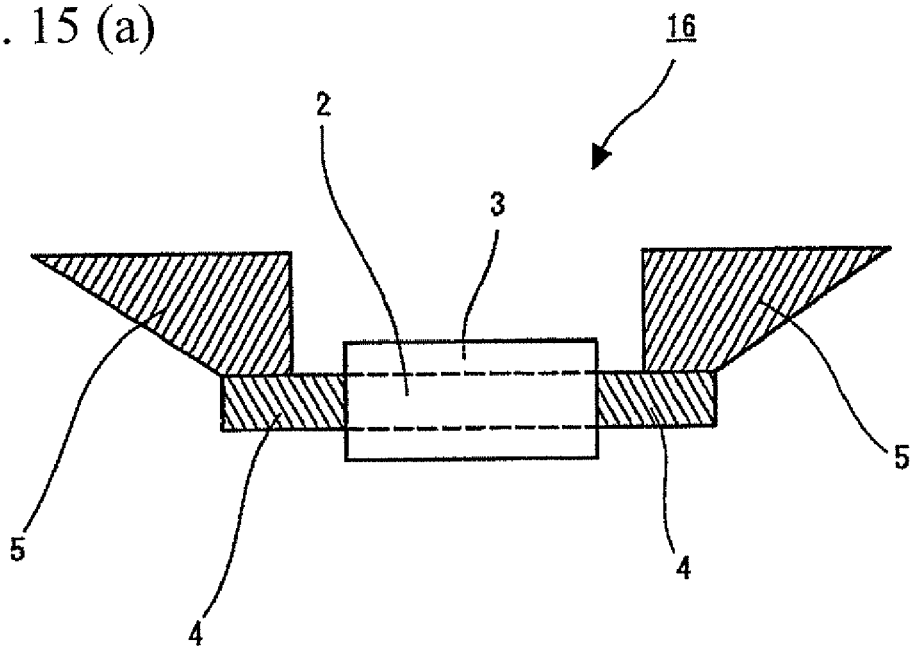
FIGS. 15(*a*) and (*b*) depict another structure of the antenna in the fifth embodiment of the radio controlled timepiece provided with an antenna of the present invention.
Figure 15:
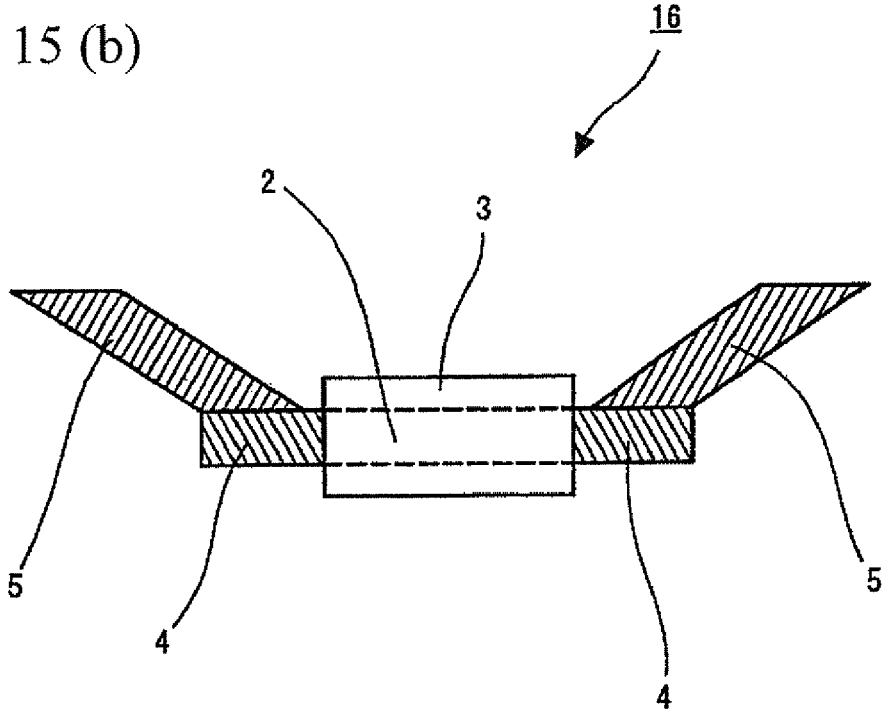

[Explanation of Antenna: FIGS. 13, 14, and 15]

Next, a fifth embodiment of the radio controlled timepiece provided with an antenna of the present invention will be explained. FIG. 13(*a*) is a cubic diagram schematically illustrating the shape of the antenna for radio controlled timepiece of the present invention, and FIG. 13(*b*) is a cubic diagram of schematic illustration for explaining the arrangement in the radio controlled timepiece.

In FIG. 13, reference numeral 11 is an upper standing portion to which a windshield glass or bezel provided at an upper part of the watch exterior 1 is attached. Reference numeral 12 is an inner-wall end face of the watch exterior 1. Reference numeral 13 is an upper opening end face of the upper standing portion 11. Note that, the same reference numerals are given to the configuration already explained.

The upper standing portion 11 may be constituted integrally with the watch exterior 1 or separately in contact therewith, while the upper opening end face 13 is an exterior opening portion of the watch exterior 1.

In FIG. 13, the extension portion 4 is expressed smaller than that in FIG. 1 in the first embodiment, but it is only necessary that the extension portion is wider than the end portion 21 of the magnetic core 2, and as in the first embodiment, the extension portions 4 may be made bigger. That is, if an area of the flat plate face of the extension portion 4 is larger than an the area of the end portion 21 of the magnetic core 2, an area for receiving the magnetic flux is increased, and the receiving sensitivity of the wave can be increased.

The standing portion 5 has a role to collect the magnetic flux flowing in parallel with the time display measure (dial plate, for example) and to have it flow to the extension portion 4 placed in the direction of the back lid 30, as mentioned above. Thus, the standing portion 5 and the extension portion 4 are preferably made of a material in which the magnetic flux easily flows in a direction orthogonal to each other, and preferably formed by a ferromagnetic body without having non-isotropy such as ferrite and the like.

Since the standing portion 5 shown in FIG. 13 is in a block shape without having a complex shape such as a curve shape and the like, for example, its impact resistance is high even if it is formed by ferrite. Since the wrist-watch type radio controlled timepiece among the radio controlled timepieces is operated while wearing on the human body, there can be a case of unexpected accident such as a drop and the like. Even in such a case, the standing portion 5 is not broken in the antenna of the present invention.

In addition, if the magnetic core 2, the extension portion 4, and the standing portion 5 each are constituted in the separate bodies, the shape of each component becomes simplified and easier to be manufactured. Further, even in the watch exterior 1 having a complicated structure, they can be magnetically coupled to each other without interfering with the other components, respectively. That is, the antenna shape according to an empty space can be formed while avoiding the components constituting the watch. Note that, measures for connecting the magnetic core 2, the extension portion 4, and the standing portion 5 to each other will be described later.

FIG. 14 is an end face diagram schematically illustrating a state where the radio controlled timepiece provided with the antenna of the present invention is seen from the direction of 3 o'clock or the direction of 9 o'clock. In FIG. 14, reference numeral 50 is a lateral end face of the standing portion 5. A dotted line A is a virtual line, and L1 is a distance between the upper opening end face 13 and the lateral end face 50.

The size of the standing portion 5 is preferably as large as possible in order to collect much more magnetic flux, but if the watch exterior 1 is formed by metal, as have been already explained, the watch exterior 1 and the standing portion 5 should not be too close to each other, and the lateral end face 50 of the standing portion 5 is separated from the inner-wall end face 12 or the upper opening end face 13.

However, even though the lateral end face 50 is separated from the inner-wall end face 12, if the upper standing portion 11 hangs over the upper face of the standing portion 5 like a canopy, inflow of the magnetic flux is prevented by the upper standing portion 11.

That is, in order not to prevent the inflow of the magnetic flux while collecting much more magnetic flux, the standing portion 5 is preferably not covered by the watch exterior 1 or a member of the same material in contact therewith (bezel or the upper standing portion 11, for example) when seen from the side where much more magnetic flux flows in (upper side of the figure in the example of FIG. 14).

Therefore, as shown in FIG. 14, the lateral end face 50 of the standing portion 5 is, as shown in FIG. 14(*a*), substantially matched with the upper opening end face 13 in the planar view, or as shown in FIG. 14(*b*), located in the center direction (center direction of the watch exterior 1 in the figure) of the watch exterior 1 rather than the upper opening end face 13.

In FIG. 14(*a*), the upper opening end face 13 and the lateral end face 50 are shown as being matched in the planar view with each other on the virtual line A. In FIG. 13(*b*), the upper opening end face 13 and the lateral end face 50 are shown as being separated from each other by the distance L1.

In an example shown in FIG. 14(*b*), the upper standing portion 11 is expressed smaller than the expression shown in FIG. 14(*a*), but of course, not limited to that. It is only necessary that the lateral end face 50 of the standing portion 5 is not overlapped with the upper opening end face 13 by changing the shape of the antenna 16 in the planar view, for example, changing the length of the coil 3 or the extension portion 4, and the like.

In FIG. 14, the windshield glass (not shown), is provided at a portion where the upper opening end faces 13 are opposed to each other in many cases, and by employing such configuration, the magnetic flux transmitted through the time display measure from the windshield glass side can be effectively collected, and the sensitivity of the radio controlled timepiece can be increased.

FIG. 15 is a diagram for explaining another shape of an antenna of the present invention. FIG. 15(*a*) shows the standing portion 5 not in the block shape as shown in FIGS. 13 and 14 but with a trapezoidal section obtained by widening the one direction. For example, by widening the time display measure side (not shown), the magnetic flux from that direction can be collected by a wider area.

Of course, it is only necessary that the magnetic flux can be easily led to the magnetic core 2, and FIG. 15(*b*) shows such an example. By making the section of the standing portion 5 parallelogram, the magnetic flux from the standing portion 5 can easily be led to the magnetic core 2 through the extension portion 4.

The shape of the standing portion 5 shown in FIG. 15 is an example and naturally not limited to that. What is important is that a face of the standing portion 5 is provided wide in the direction where the wave is coming and the shape of the standing portion 5 is devised so that the magnetic flux can easily be led to the magnetic core 2.

Supposing that the time display measure or the windshield glass is disposed on the upper side in the figure in FIG. 15, by employing such configuration, the magnetic flux can be collected effectively from these sides, and the sensitivity of the radio controlled timepiece can be further increased.

EXAMPLE 6

Figure 16:
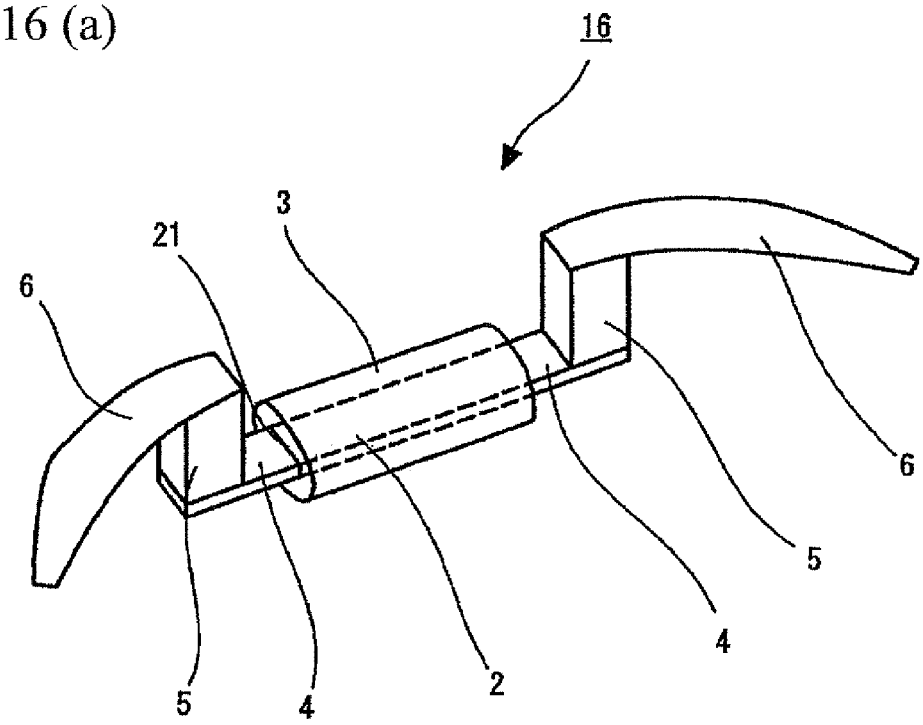
FIGS. 16(*a*) and (*b*) a structure and arrangement of an antenna in a sixth embodiment of the radio controlled timepiece provided with an antenna of the present invention.
Figure 16:
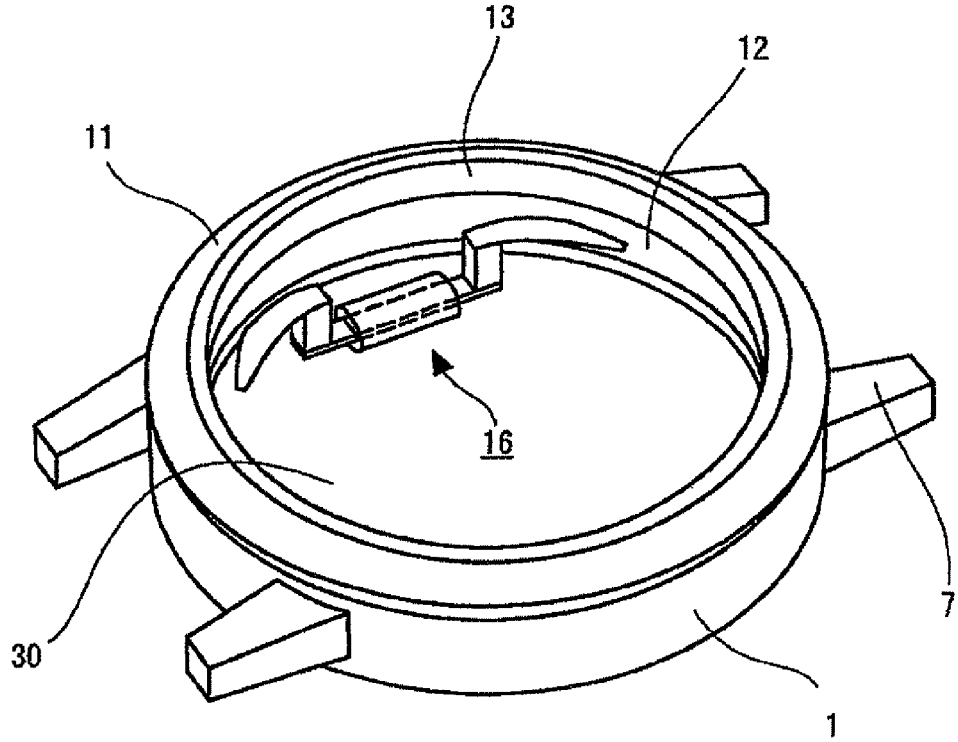

[Explanation of Different Structure of Antenna: FIG. 16]

Next, a sixth embodiment of the radio controlled timepiece provided with an antenna of the present invention will be explained. The sixth embodiment is configured so that further much more magnetic flux can be collected, and a magnetism-collecting member formed by a magnetic body is further provided at the standing portion 5 formed by the magnetic body connected to the extension portion 4.

The sixth embodiment of the radio controlled timepiece provided with an antenna of the present invention will be explained below by using the attached drawings. FIG. 16(*a*) is a cubic diagram schematically illustrating the shape and FIG. 16(*b*) is a cubic diagram of schematic illustration for explaining the arrangement in the radio controlled timepiece.

In FIG. 16, reference numeral 6 is a magnetism-collecting member. Reference numeral 16 is an antenna having the magnetic core 2, the coil 3, the extension portion 4, the standing portion 5, and the magnetism-collecting member 6. The same reference numerals are given to the configuration already explained, but to the antenna in the sixth embodiment, the same reference numeral 16 as in the embodiment of the radio controlled timepiece provided with an antenna of the present invention that has been already explained is given for ease of explanation.

The magnetism-collecting member 6 is formed by a ferromagnetic body and magnetically coupled with the standing portion 5 through a contact face. The magnetism-collecting member 6 may be formed by an amorphous laminate material, for example.

The magnetism-collecting member 6 has a flat-plate shape opposed to the time display measure (dial plate, for example, not shown), provided in the direction of the upper standing portion 11 or the back lid 30, collects much more magnetic flux flowing in parallel with the time display measure and has a role to have it flow to the extension portion 4 placed in the direction of the back lid 30.

The magnetism-collecting member 6 has an area larger than the area where the standing portion 5 and the magnetism-collecting member 6 are in contact with each other and preferably as large as possible inside the watch exterior 1 as already explained. In an example shown in FIG. 16, the magnetism-collecting member 6 has a curved shape but may be formed in a larger wing shape inside the watch exterior 1 separated therefrom.

In addition, the standing portion 5 should have high magnetic permeability in the direction from the time display measure side to the back lid side (vertical direction in FIG. 16), but if the magnetic core 2 is formed by the amorphous laminate material, when the magnetic core 2 and the magnetism-collecting member 6 are electrically conducted, the eddy current flows through the entire antenna 16, which increases a loss. Therefore, preferably the standing portion 5 is also an insulating material.

Since in the amorphous laminate material, a direction with high magnetic permeability and a direction with high electric conductivity match each other, the property is not satisfied, and it is not preferable to be used for the standing portion 5. From this point of view, the standing portion 5 is preferably formed by ferrite.

In this case, too, the standing portion 5 shown in FIG. 16 is not in a complicated shape such as being curved and the like, and even if it is formed by ferrite, impact resistance is high and even if the radio controlled timepiece receives an impact, the standing portion 5 is not broken. It is needless to say that the standing portion 5 may be in the shape as shown in FIG. 15.

Figure 17:
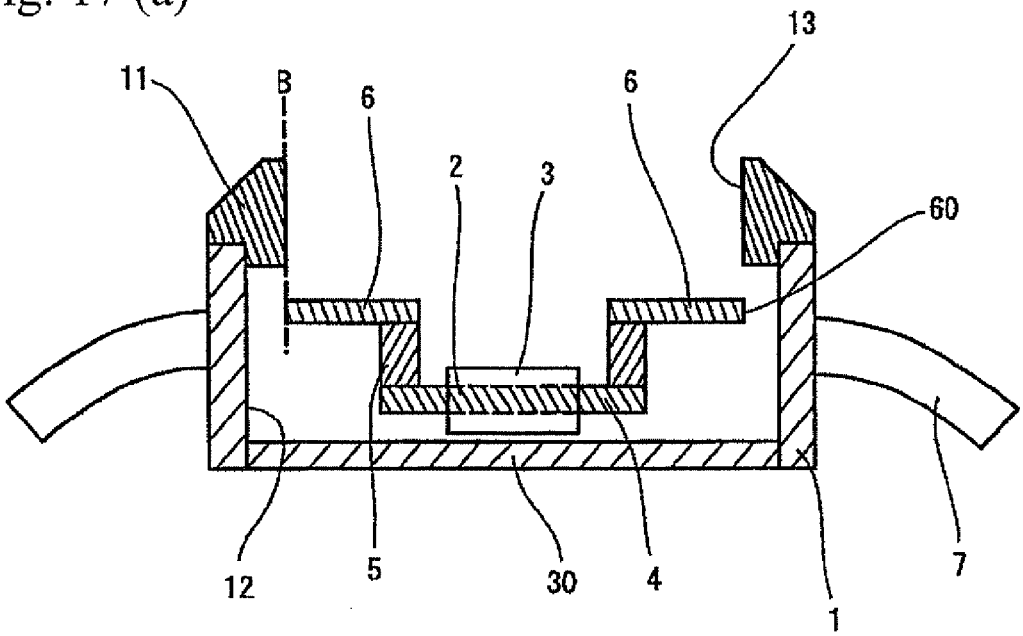
FIGS. 17(*a*) and (*b*) depict positions of the antenna and a watch exterior in the sixth embodiment of the radio controlled timepiece provided with an antenna of the present invention.
Figure 17:
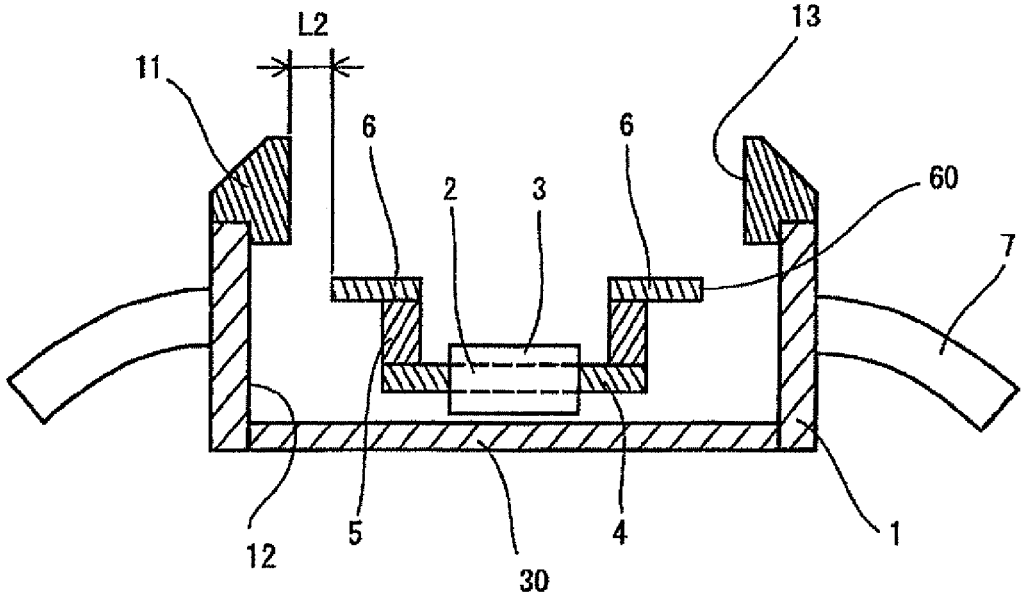
Figure 18:
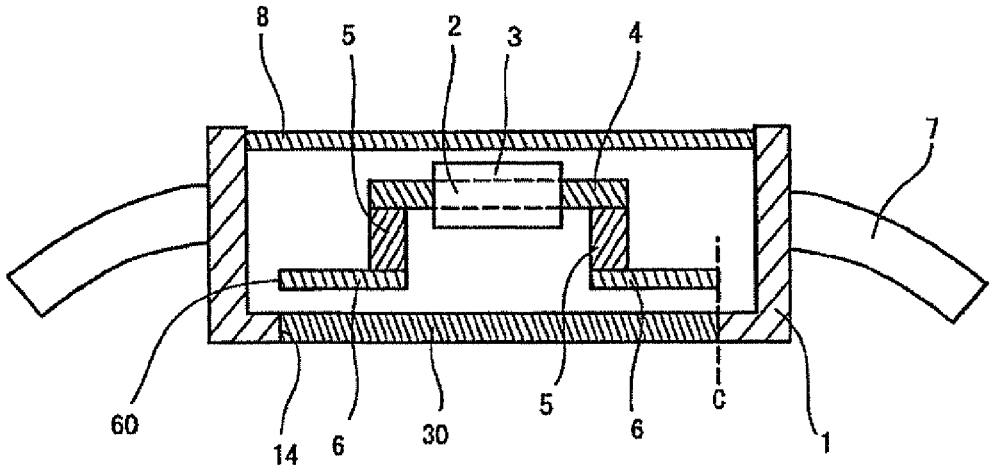
FIGS. 18(*a*) and (*b*) depict positions of the antenna and a watch exterior in another example in the sixth embodiment of the radio controlled timepiece provided with an antenna of the present invention.
Figure 18:
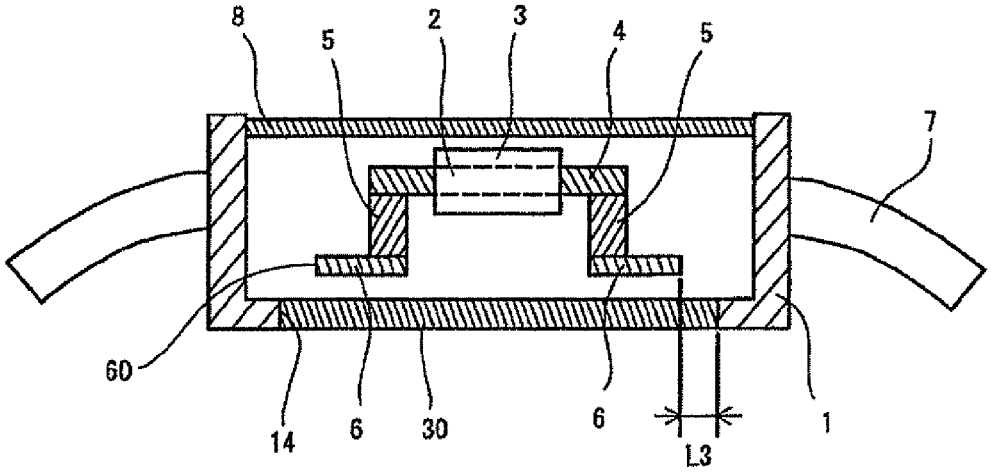

[Explanation of Arrangement of Antenna: FIGS. 17 and 18]

FIG. 17 is an end face diagram schematically illustrating a state where the radio controlled timepiece provided with an antenna of the present invention is seen from the direction of 3 o'clock or the direction of 9 o'clock. In FIG. 17, reference numeral 60 is an end face of the magnetism-collecting member 6. A dotted line B is a virtual line, and L2 is a distance between the upper opening end face 13 and an end portion 60.

The size of the magnetism-collecting member 6 is, similarly to the example of the extension portion 4 in the first embodiment of the radio controlled timepiece provided with an antenna of the present invention, preferably as large as possible in order to collect much more magnetic flux. However, when the watch exterior 1 is formed by metal, as already explained, the watch exterior 1 and the magnetism-collecting member 6 should not be too close to each other, and the end portion 60 of the magnetism-collecting member 6 is separated from the inner-wall end face 12 or the upper opening end face 13.

However, even though the end portion 60 is separated from the inner-wall end face 12, if the upper standing portion 11 hangs over the upper face of the magnetism-collecting member 6 like a canopy, inflow of the magnetic flux is prevented by the upper standing portion 11.

That is, in order not to prevent the inflow of the magnetic flux while collecting much more magnetic flux, it is better that the magnetism-collecting member 6 is not covered by the watch exterior 1 or a member of the same material in contact therewith (bezel or upper standing portion 11, for example) when seen from the side where much more magnetic flux flows in (upper side of the figure in the example of FIG. 17).

Therefore, in the example shown in FIG. 17, the end portion 60 of the magnetism-collecting member 6 is preferably located substantially matching the upper opening end face 13 in the planar view as shown in FIG. 17(*a*) or in the center direction (center direction of the watch exterior 1 in the figure) of the watch exterior 1 rather than the upper opening end face 13 as shown in FIG. 17(*b*).

In FIG. 17(*a*), the upper opening end face 13 and the end portion 60 are shown as being matched with each other on the virtual line B in the planar view. In FIG. 17(*b*), the upper opening end face 13 and the end portion 60 are shown as being separated from each other by the distance L2.

Similarly to the example shown in FIG. 14, the windshield glass (not shown), is provided at a portion where the upper opening end faces 13 are opposed to each other in many cases in FIG. 17, and by employing such configuration, the magnetism-collecting member 6 becomes flat when seen from the windshield glass side and even if there is a dial plate (not shown), the magnetic flux can be collected more effective, and the sensitivity of the radio controlled timepiece can be increased.

Further, in an example shown in FIG. 17, the magnetism-collecting member 6 is extended in a direction separated from the magnetic core 2 from the standing portion 5, but not limited to that, the member may be extended in a direction approaching the magnetic core 2 from the standing portion 5 or may be extended in the both directions. However, if the magnetism-collecting member 6 is extended in the direction approaching the magnetic core 2 from the standing portion 5, similarly to the case of the extension portion 4 mentioned above, it is necessary that the coil 3 wound around the magnetic core 2, extension portion 4 extended from the different end portion of the magnetic core 2, and the magnetism-collecting member 6 magnetically coupled with the extension portion 4 should not be overlapped with each other in the planar view.

FIG. 18 is an end face diagram schematically showing a state where the radio controlled timepiece provided with an antenna of the present invention is seen from the direction of 3 o'clock or the direction of 9 o'clock similarly to FIG. 7. This figure shows an example in which the standing portion 5 and the magnetism-collecting member 6 are arranged in the direction of the back lid 30.

In FIG. 18, the back lid 30 is formed by an insulating material. Reference numeral 14 is a lower opening end face where the watch exterior 1 and the back lid 30 are in contact with each other. A dotted line C is a virtual line and L3 is a distance between the lower opening end face 14 and the end portion 60. The same reference numerals are given to the configuration that has been already explained.

Since a wrist watch also has a role as an article of taste, a metal member is used in a dial plate which should be considered as the "face" of the watch for the purpose of acquiring texture in many cases. If the dial plate is formed by metal, the magnetic flux is shielded, and inflow of the magnetic flux from the dial plate side (side of the windshield glass, not shown) is remarkably lowered.

Therefore, as shown in FIG. 18, by forming the back lid 30 by an insulating body such as plastic and the like, and by disposing the standing portion 5 and the magnetism-collecting member 6 on the back lid 30 side, the magnetic flux can be obtained efficiently from the back lid 30 side.

The size of the magnetism-collecting member 6 is preferably as large as possible in order to collect much more magnetic flux as in the example shown in FIG. 17, but when the watch exterior 1 is formed by metal, the watch exterior 1 and the magnetism-collecting member 6 should not be too close to each other. If the lower opening end face 14 hangs over the end portion 60 of the magnetism-collecting member 6 like a canopy at the upper face of the magnetism-collecting member 6, the inflow of the magnetic flux is prevented.

That is, in order not to prevent the inflow of the magnetic flux while collecting much more magnetic flux, it is better that the magnetism-collecting member 6 is not covered by the watch exterior 1 when seen from the side where much more magnetic flux flows in (lower side of the figure in the example in FIG. 18).

Therefore, in an example shown in FIG. 18, it is better that the end portion 60 of the magnetism-collecting member 6 is, as shown in FIG. 18(*a*), substantially matched with the lower opening end face 14 in the planar view or as shown in FIG. 18(*b*), is located in the center direction (center direction of the watch exterior 1 in the figure) of the watch exterior 1 rather than the lower opening end face 14.

In FIG. 18(*a*), the lower opening end face 14 and the end portion 60 are shown to be matched with each other on the virtual line C in the planar view. In addition, in FIG. 18(*b*), the lower opening end face 14 and the end portion 60 are shown to be separated from each other by the distance L3.

In an example shown in FIG. 18, the antenna 16 is provided adjacently to the time display measure 8, but it is needless to say that the antenna may be provided adjacently to the back lid 30. What is important is that the standing portion 5 or the magnetism-collecting member 6 is faced with the side where the magnetic flux advances.

By employing such configuration, much more magnetic flux can be collected from the back lid side, and the sensitivity of the radio controlled timepiece can be increased.

Figure 19:
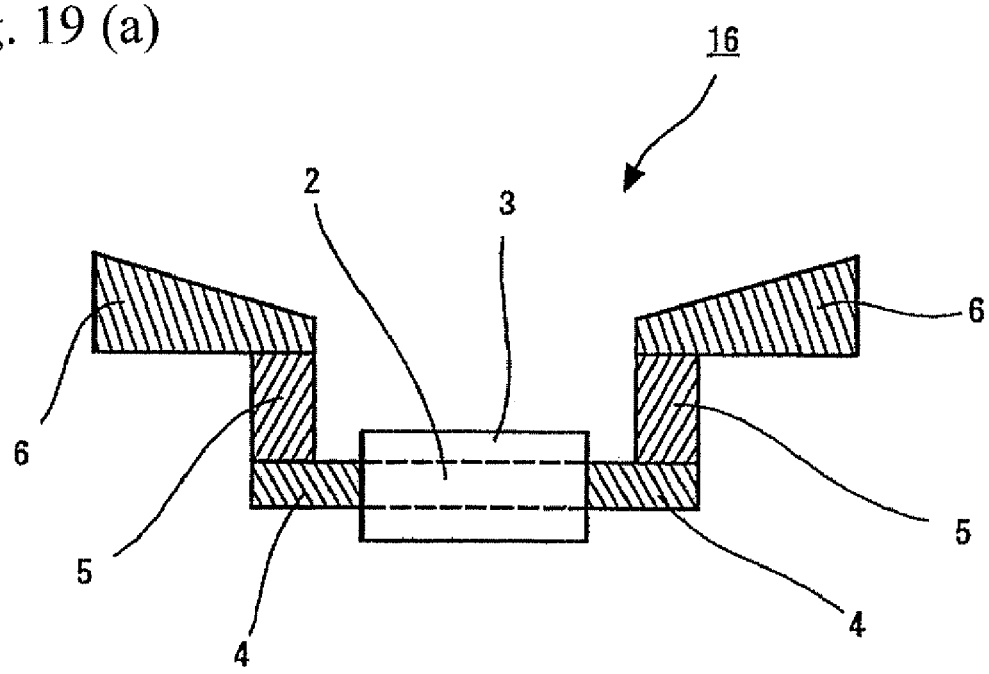
FIGS. 19(*a*) and (*b*) depict another structure of the antenna in the sixth embodiment of the radio controlled timepiece provided with an antenna of the present invention.
Figure 19:
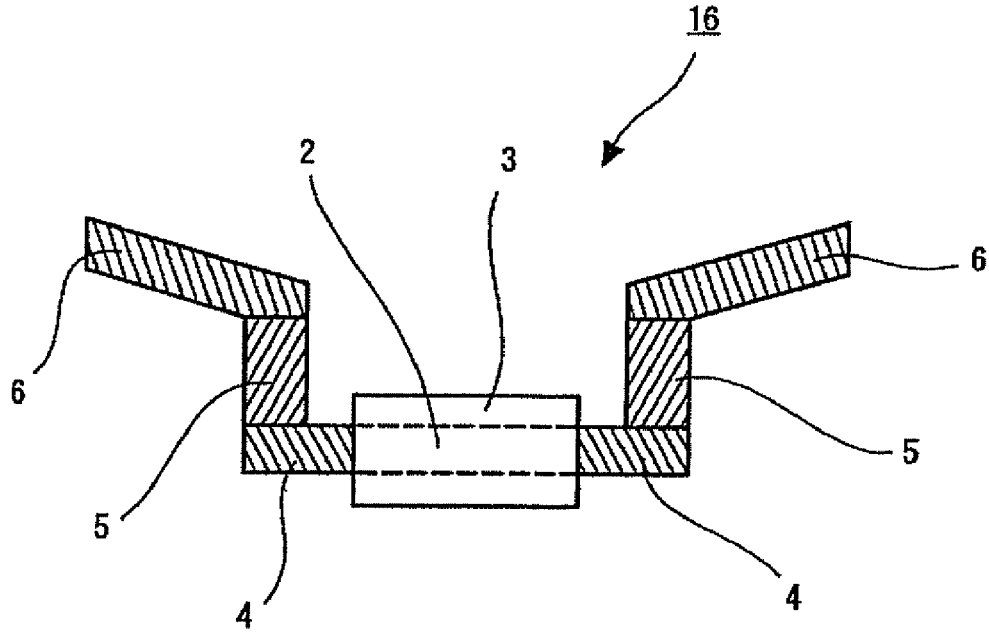

[Explanation of Different Structure of Antenna: FIG. 19]

FIG. 19 is a diagram for explaining another shape of an antenna of the present invention. FIG. 19(*a*) shows the magnetism-collecting member 6 not in a uniform flat-plate shape but in a state where the thickness is widened in one direction. For example, by widening the thickness toward the time display measure side (not shown), the magnetic flux can be collected also from that side face so that the magnetic flux can be collected cubically. It is needless to say that only making the magnetic flux to be easily led to the magnetic core 2, and FIG. 19(*b*) shows a state that a section of the magnetism-collecting member 6 is similarly made in the shape of a parallelogram so that the magnetic flux from the magnetism-collecting member 6 is easily led to the extension portion 4.

The shape of the magnetism-collecting member 6 shown in FIG. 19 is only an example and naturally not limiting. What is important is to form the magnetism-collecting member 6 cubically with respect to the wave-coming direction or to make the shape easier to lead the magnetic flux to the magnetic core 2 by devising the shape of the magnetism-collecting member 6.

Supposing that the time display measure or the windshield glass is disposed in the upper side of FIG. 19, the magnetic flux can be effectively collected from these sides by employing such configuration, but if the back lid 30 is formed by an insulating material as in the example shown in FIG. 18, it is needless to say that the similar configuration may be provided on the back lid 30 side.

[Explanation of Coupling Structure of the Extension Portion 4, the Standing Portion 5, and the Magnetism-collecting Member 6: FIGS. 20 to 24]

Next, the coupling structure of the extension portion 4, the standing portion 5, and the magnetism-collecting member 6 will be explained. FIGS. 20 to 24 explain the configuration of connecting them, in which reference numeral 19 is a fixing member, 20 for a screw, 22 for a bolt, 23 for a washer, 28 for an urging measure and 40 for a nut. Reference numeral 52 is a standing portion projection in a convex shape provided at the standing portion 5, 53 for a concave portion provided at the standing portion 5, and 55 for a groove in a notch shape provided at the standing portion 5. Reference numeral 62 is a hole portion provided at the magnetism-collecting member 6 and 63 for a magnetism-collecting member projection in a convex shape provided at the magnetism-collecting member 6. The same reference numerals are given to the configuration having been already explained.

Figure 20:
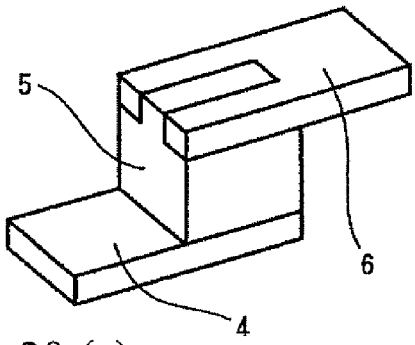
FIGS. 20(*a*) and (*e*) are a series of perspective views showing a joint structure of the extension portion, standing portion, and magnetism-collecting member of the antenna of the present invention.
Figure 20:
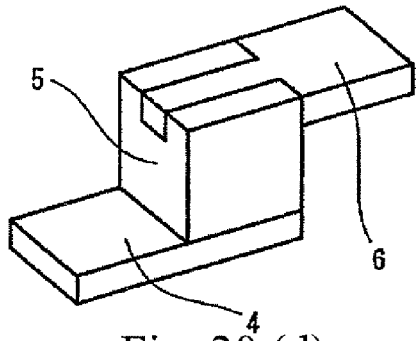
Figure 20:
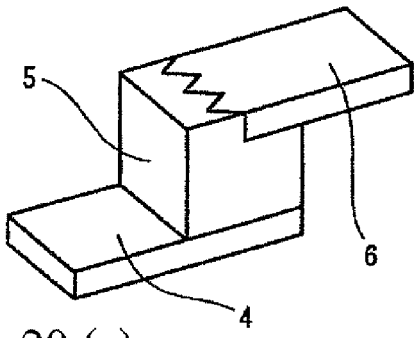
Figure 20:
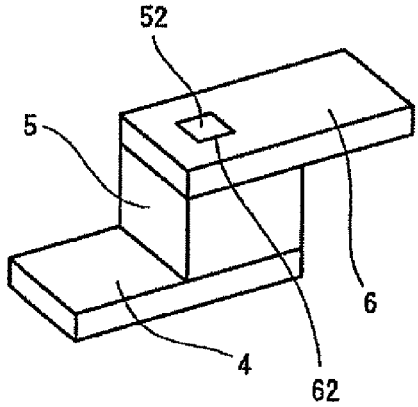
Figure 20:
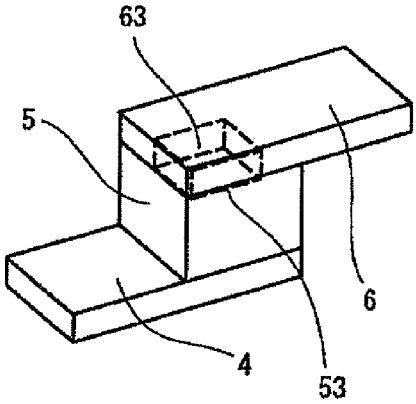

In FIG. 20, FIGS. 20(*a*) and 20(*b*) are for explaining the configuration of fitting between the standing portion 5 and the magnetism-collecting member 6 by providing a engaging groove at one of the standing portion Sand the magnetism-collecting member 6 and by providing a shape to be fitted with the engaging groove at the other of them. FIG. 20(*a*) shows an example of providing the engaging groove at the magnetism-collecting member 6, and FIG. 20(*b*) shows an example of providing the engaging groove at the standing portion 5. By employing such configuration, contact areas of the standing portion 5 and the magnetism-collecting member 6 are enlarged, and the magnetic coupling degree is increased.

FIG. 20(*c*) is for explaining the configuration in which a joint face between the standing portion 5 and the magnetism-collecting member 6 in a serrated shape. By employing such configuration, both contact areas are enlarged and the magnetic coupling degree is increased.

FIG. 20(*d*) is for explaining the configuration in which the standing portion projection 52 of the standing portion 5 is inserted through the hole portion 62 of the magnetism-collecting member 6 for fitting. By employing such configuration, both are firmly connected and the magnetic coupling degree is increased.

FIG. 20(*e*) is a configuration in which the magnetism-collecting member projection 63 of the magnetism-collecting member 6 is fitted with the concave portion 53 of the standing portion 5. It is needless to say that similarly to the example shown in FIG. 20(*d*) described above, the standing portion projection may be provided at the standing portion 5 and the concave portion may be provided at the magnetism-collecting member 6, and at that time, the standing portion projection provided at the standing portion 5 does not have to be inserted through the magnetism-collecting member 6.

Figure 21:
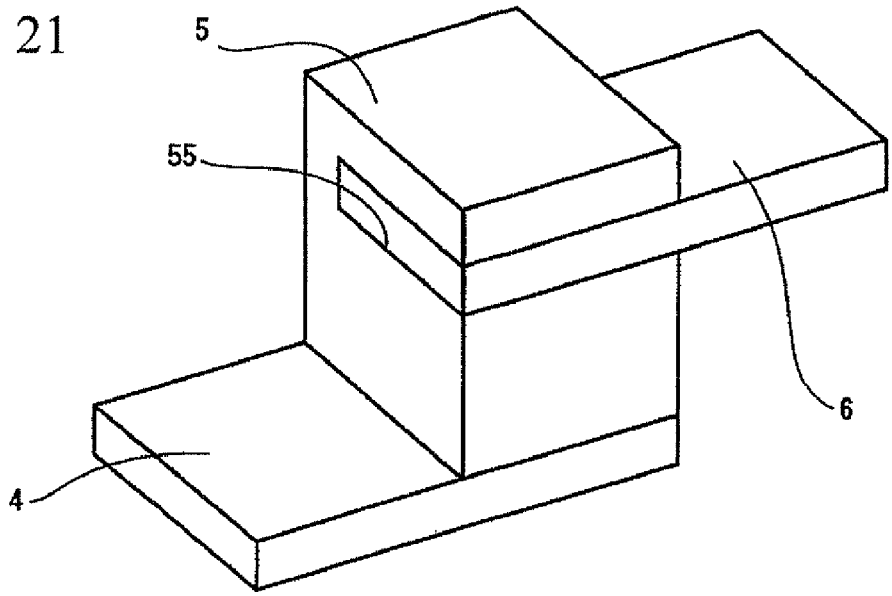
FIG. 21 is a perspective view depicting a joint structure of the extension portion, standing portion, and magnetism-collecting member of the antenna of the present invention.

FIG. 21 is for explaining the configuration in which a groove is provided at the standing portion 5, in which the magnetism-collecting member 6 is held. The groove 55 in the shape of a notch can fix the magnetism-collecting member 6 by forming the groove equal to or slightly wider than the thickness of the magnetism-collecting member 6.

The configuration in which the notch-shaped groove 55 is provided can be constituted simply. That is because a known working technique such as a cutting of the standing portion 5 configured in the block shape and the like can be used. By employing such configuration, the standing portion 5 and the magnetism-collecting member 6 can be connected simply, and the magnetic coupling degree can be increased.

Figure 22:
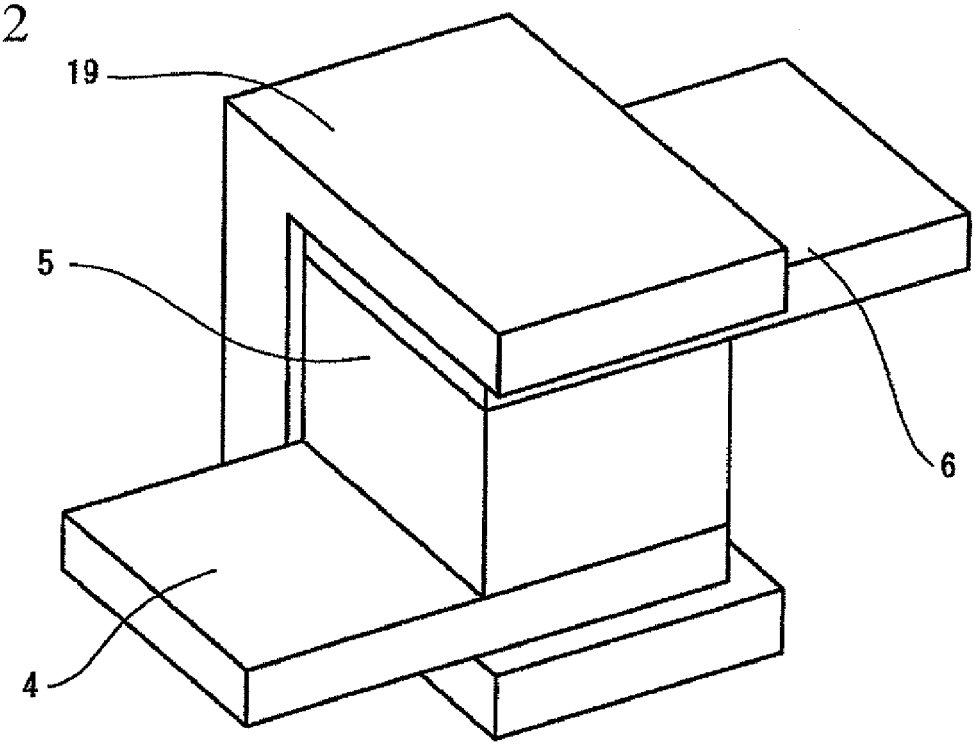
FIG. 22 is a perspective view showing a joint structure of the extension portion, standing portion, and magnetism-collecting member of the antenna of the present invention.

FIG. 22 is for explaining the configuration using the fixing member 19 for fixing the extension portion 4, the standing portion 5, and the magnetism-collecting member 6. The fixing member 19 has the channel-shape, for example, and sandwiches these portions and a member to fix. By employing such configuration, the magnetic coupling degree can be increased.

The shape of the fixing member 19 is not limited to the channel-shape. Though not shown, the member may be a ring shape so as to fix the extension portion 4, the standing portion 5, and the magnetism-collecting member 6 by having them inserted therethrough. A material of the fixing member 19 is an insulating material, preferably having elasticity to some extent, and the member is formed by plastic, for example.

Figure 23:
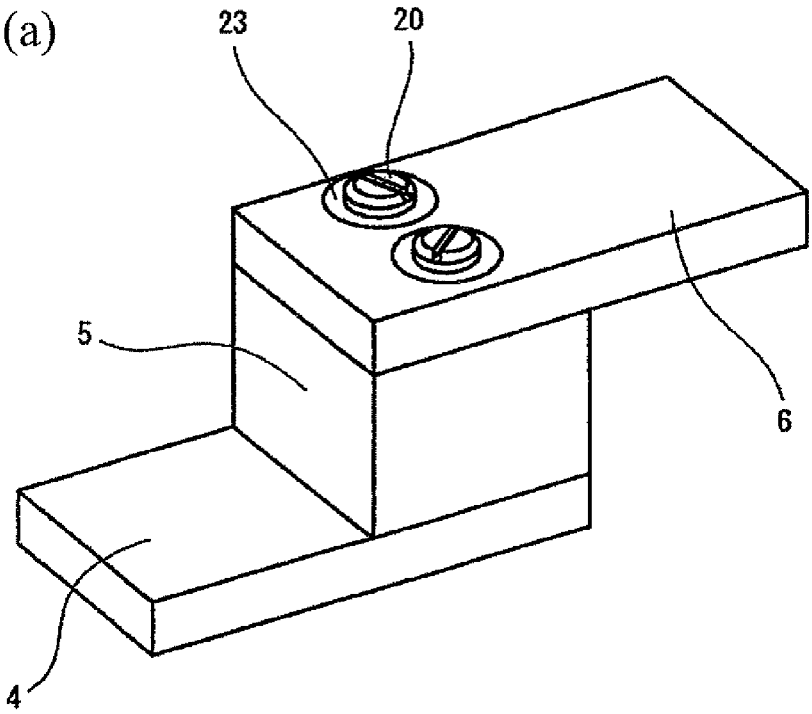
FIGS. 23(*a*) and (*b*) depict examples using a screw mechanism in the joint of the extension portion, standing portion, and magnetism-collecting member of the antenna of the present invention.
Figure 23:
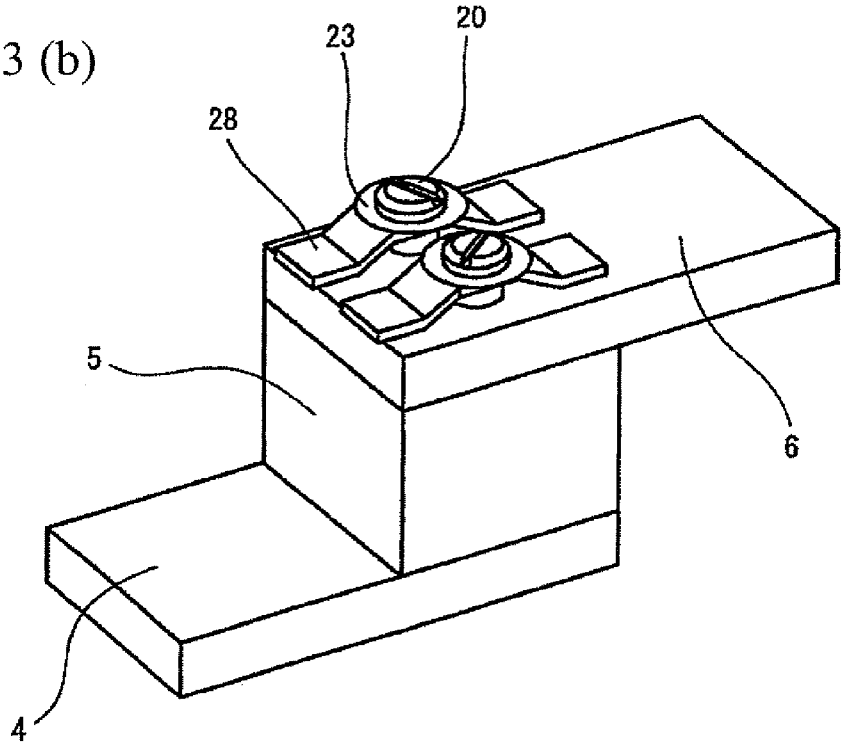
Figure 24:
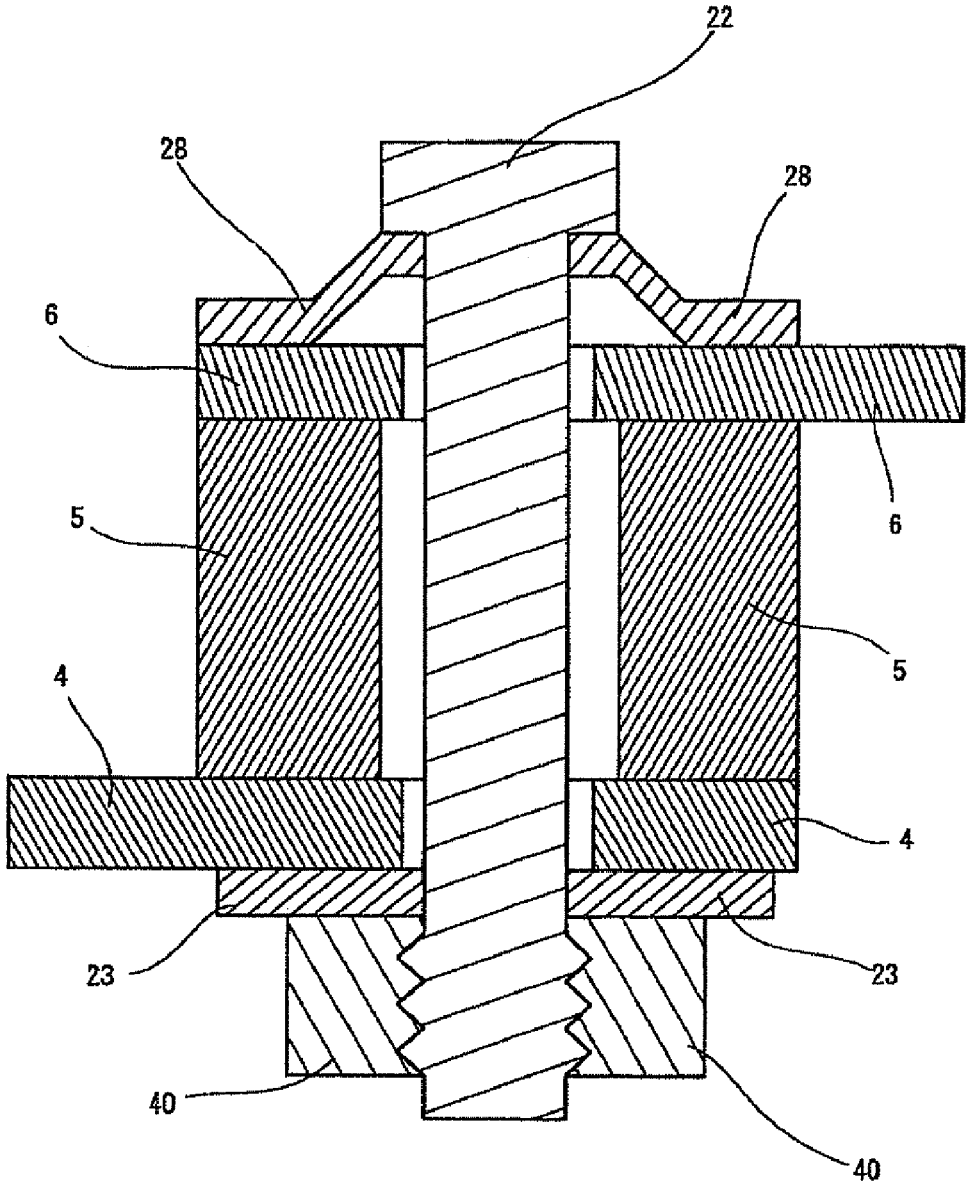
FIG. 24 is a cross-sectional view depicting another example using a screw mechanism in the joint of the extension portion, standing portion, and magnetism-collecting member of the antenna of the present invention.

FIGS. 23 and 24 are for explaining an example of fastening and fixing the standing portion 5 and the magnetism-collecting member 6 using a screw mechanism. The urging measure 28 may be any type as long as an urging force is generated against the fastening by a screw 20, and a leaf spring is used in the example shown in FIGS. 23 and 24. It is needless to say that a spring or spring washer and the like may be used. The screw mechanism is a mechanism of fixing a member by adding the screw 20, the washer 23 or the urging measure 28.

FIG. 23(*a*) shows an example in which the standing portion 5 and the magnetism-collecting member 6 are fastened and fixed using the screw 20 and the washer 23.

FIG. 23(*b*) shows an example of fastening and fixing further by using the urging measure 28. Since an appropriate urging force is applied by the urging measure 28, firmer fastening and fixing can be realized, and at the same time, if the antenna of the present invention is equipped on the radio controlled timepiece, the screw 20 is prevented from loosening by vibration and the like generated during the use of timepiece. By employing such configuration, the magnetic coupling degree can be increased.

In the configuration shown in FIG. 23, the size and the number of the respective elements constituting the screw mechanism can be freely selected. Considering the shape and material of the standing portion 5 or the magnetism-collecting member 6, the washer 23 with the larger size may be selected so as to distribute the fastening force of the screw 20 more widely and to prevent the destruction such as crack and the like.

FIG. 24 is for explaining the configuration in which the destruction such as crack and the like of the standing portion 5 or the magnetism-collecting member 6 occurs more hardly. FIG. 24 is a configuration similar to that of FIG. 23(*b*) but it is a sectional diagram schematically illustrating its sectional shape in order to explain a case in which the bolt 22 and the nut 40 are used instead of the screw 20.

As have been already explained, there might be a case in which the material forming the standing portion 5 or the magnetism-collecting member 6 is a brittle material. In such case, the standing portion 5 or the magnetism-collecting member 6 might be cracked or broken by a stress generated when the screw 20 is screwed into the standing portion 5.

In order to prevent the ease-to-be-broken caused by a material used for the standing portion 5 or the magnetism-collecting member 6 as above, a through port is provided in the extension portion 4, the standing portion 5, and the magnetism-collecting member 6 as shown in FIG. 24, through which the bolt 22 is inserted and fastened through the nut 40 and the like.

By employing such configuration, stress is not generated at the standing portion 5 or the magnetism-collecting member 6 during the fastening of the screw 20, and destruction such as crack and the like will not occur.

A material of the screw, the washer, the bolt and the like constituting the screw mechanism can be freely selected, but in order to easily lead the magnetic flux to the magnetic core 2, is preferably an insulating body. Though not particularly limited, plastic can be used to form.

In addition, though not shown, a screw, a nut and a bolt used as a component constituting a watch equipped on the watch exterior 1 may be shared by the screw 20, the bolt 22 and the nut 40. Further, it is needless to say that the screws and nuts may be fastened together.

Furthermore, in the configuration shown in FIGS. 20 to 23, the connection configuration between the standing portion 5 and the magnetism-collecting member 6 have been explained, but the connection configuration can be used for the connection between the extension portion 4 and the standing portion 5, which was explained in the first embodiment, and a different connection configuration may be used for each of the connection between the extension portion 4 and the standing portion 5 as well as the connection between the standing portion 5 and the magnetism-collecting member 6.

It is needless to say that the connection configurations of the extension portion 4, the standing portion 5, and the magnetism-collecting member 6 as mentioned above may be used in combination. For example, in addition to the configuration in which a engaging groove is provided at either one of the standing portion 5 and the magnetism-collecting member 6 shown in FIG. 20, a shape to be fitted with the engaging groove is provided at the other and the both are fitted together, the fixing member 19 and the screw mechanism may be used. In short, it is only necessary that the extension portion 4, the standing portion 5, and the magnetism-collecting member 6 can be connected to one another firmly, and changes or applications in a range not departing from the gist that has been already explained are possible.

EXAMPLE 7

Figure 25:
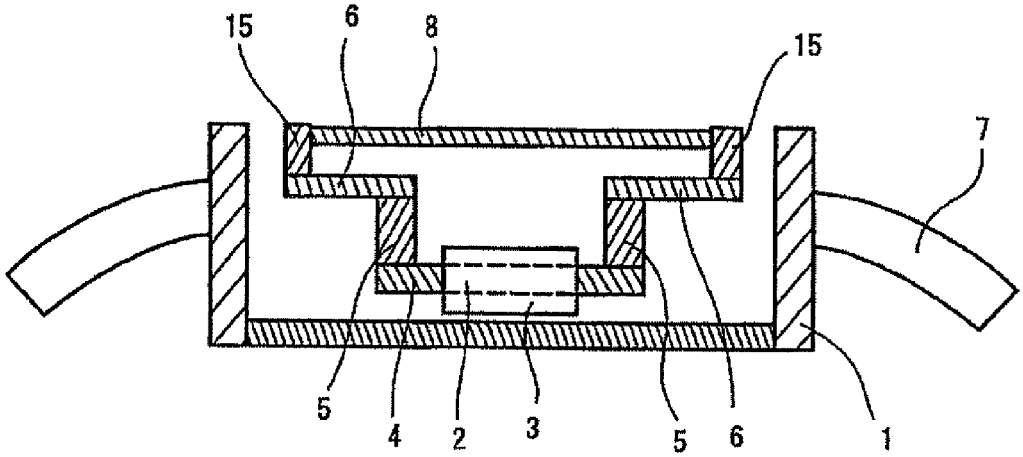
FIGS. 25(*a*) and (*b*) depict a structure of an antenna in a seventh embodiment of the radio controlled timepiece provided with an antenna of the present invention.
Figure 25:
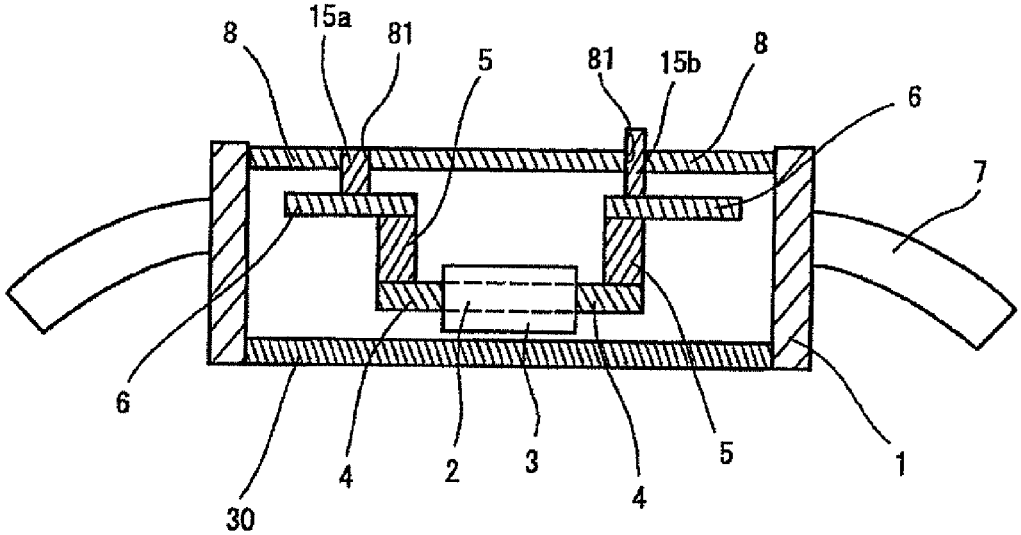
Figure 26:
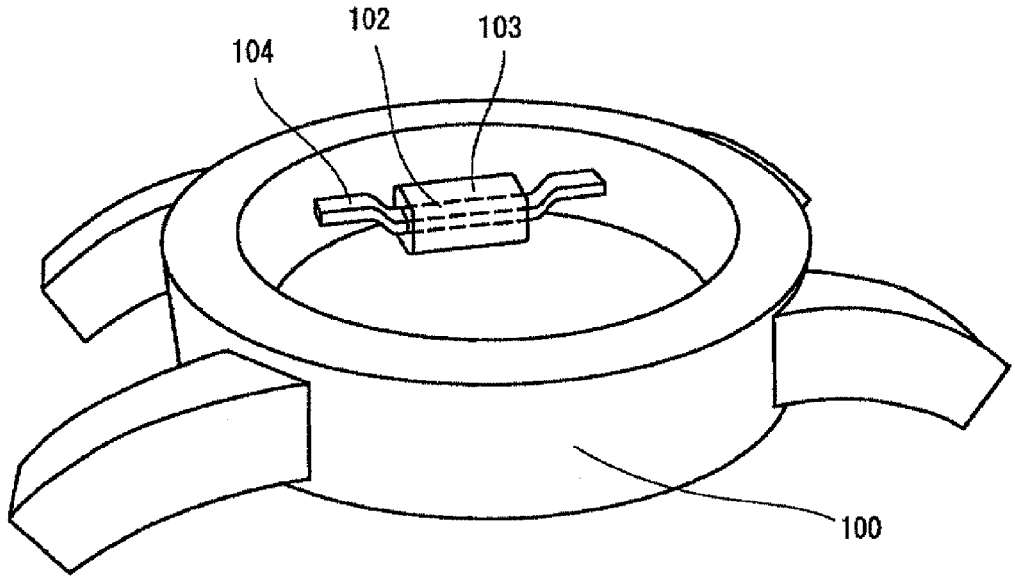
Fig. 26 Prior Art
FIG. 26 is a perspective view depicting a prior art device disclosed in Patent Document 1.
Figure 27:
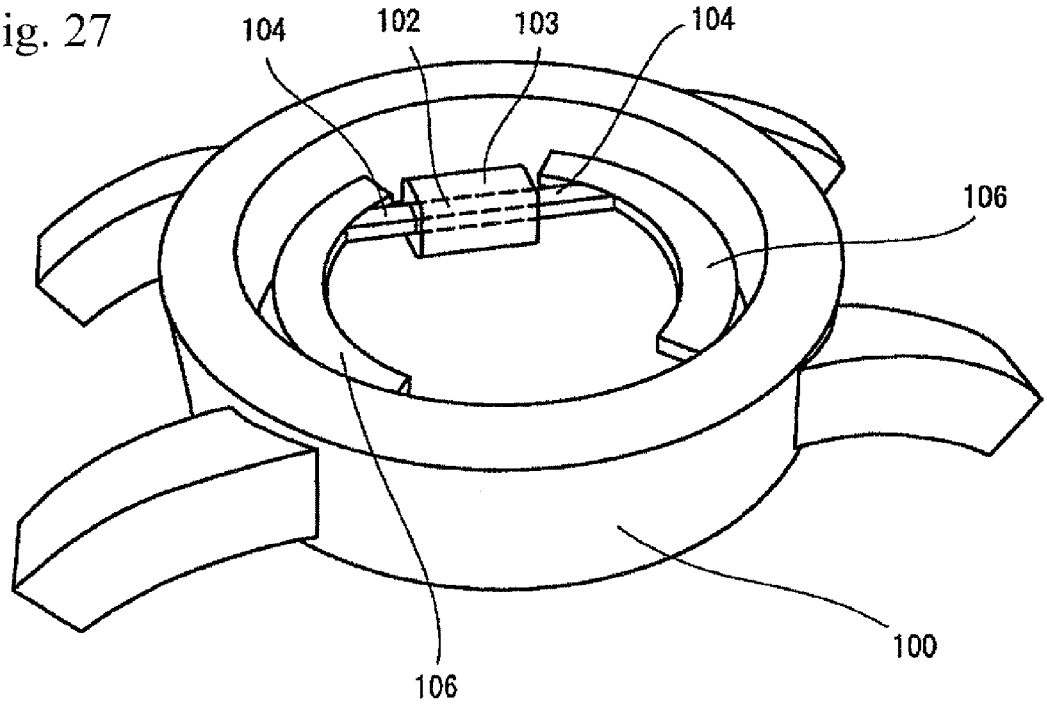
Prior Art Fig. 27
FIG. 27 is a perspective view depicting another prior art device disclosed in Patent Document 2.

[Explanation of Standing Portion: FIG. 25]

Next, a seventh embodiment of the radio controlled timepiece provided with an antenna of the present invention will be described. This seventh embodiment will be explained referring to FIG. 25. FIG. 25 is an end face diagram schematically illustrating a state where the radio controlled timepiece provided with an antenna of the present invention is seen from the direction of 3 o'clock or the direction of 9 o'clock.

In FIG. 25, reference numeral 8 denotes a time display measure and 15 for a second standing portion formed by a ferromagnetic body placed on a face of the time display measure side of the magnetism-collecting member 6. The time display measure 8 is a dial plate, for example. The second standing portion 15 may be constituted separately from the magnetism-collecting member 6 but is magnetically coupled with the magnetism-collecting member 6. The same reference numerals are given to the configuration that has been already explained.

The second standing portion 15 is provided at the end portion or its flat face or the both of the magnetism-collecting member 6. In FIG. 25(*a*), the magnetism-collecting member 6 is provided on the lower side of the time display measure 8, but the second standing portion 15 is provided at the end portion of the magnetism-collecting member 6 and is also provided to be on the same plane of the time display measure 8. If the time display measure 8 is provided as a dial plate, the dial plate is in a flat state. In FIG. 25, the second standing portion 15 and the time display measure 8 are described adjacently to each other for ease of explanation, but they may be separated from each other in some cases depending on the material forming them or the structure.

There is only a windshield glass (not shown) at the upper part of the time display measure 8 and there is no watch exterior. Thus, the magnetic flux can be easily collected from the upper direction of the time display measure 8, and since the measure is far from the case side face, a loss caused by eddy current hardly occurs. Moreover, since the magnetism-collecting member 6 forms a cubic shape, not a flat shape, by the second standing portion 15, the magnetic flux can be collected from many more directions.

Of course, there are few demerits caused by the increase in an amount of the magnetic bodies forming the antenna by providing the second standing portion 15, and the radio controlled timepiece with good sensitivity can be obtained.

In the configuration shown in FIG. 25(*a*), an example is explained, in which the second standing portion 15 is provided at the end portion of the magnetism-collecting member 6, but as long as no interference is caused by the design of the timepiece itself, the shape of the time display measure (such as a liquid crystal panel, for example), time display indexes provided on the dial plate and the like, the second standing portion 15 may be provided anywhere in the flat-face shape of the magnetism-collecting member 6.

It is needless to say that the second standing portion 15 does not have to constitute a flat face with the time display measure 8 and may be provided extending to the windshield glass side (not shown) rather than the time display measure 8, and the second standing portion 15 can be made undistinguishable or distinct to the contrary as an accent according to the design of the timepiece. In FIG. 25(*b*), a slit or a hole portion is provided at the time display measure 8, in which the second standing portion 15 is fitted. A second standing portion 15*a* is provided on the same flat face with the time display measure 8 in the planar view and a second standing portion 15*b* is provided extending to the side of the windshield glass (not shown) therefrom.

By such configuration, the second standing portion 15*a* provided on the same flat face with the time display measure 8 in the planar view and the second standing portion 15*b* provided extending to the side of the windshield glass (not shown) rather than the time display measure 8 can be used as an index member similarly to the standing portion 51 mentioned above. Thus, the second standing portion 15 and the time display measure 8 are integrated, and the options of the design are widened, and further since the second standing portion 15 has a portion not covered by the time display measure 8, much more magnetic flux can be received by the second standing portion 15, and the receiving sensitivity of the antenna can be increased.

In addition, in FIG. 25, explanation was made referring to a figure in which the second standing portion 15 is provided on the side of the windshield glass (not shown), but it may be additionally provided on the side of the back lid 30. That is, the second standing portion 15 may be provided on the both of the windshield glass side and the back lid side.

As mentioned above, the second standing portion 15 may be provided in plural or may be changed in its shape according to the shape of the radio controlled timepiece on which the antenna is equipped.

It is needless to say that for the connection configuration between the second standing portion 15 and the magnetism-collecting member 6, the connection configurations between the extension portion 4 and the standing portion 5 as well as the standing portion 5 and the magnetism-collecting member 6 that have been already explained can be used.

Further, the standing portion 5 provided at the extension portion 4 may be provided on the both of the side of the windshield glass (not shown) and the side of the back lid 30. It is needless to say that the magnetism-collecting member 6 may be provided on the both in compliance with that. By such configuration, the antenna shape becomes cubic and much more magnetic flux can be led to the magnetic core 2.

The radio-wave receiving device provided with an antenna of the present invention that has been explained is the one using the property that once the magnetic flux enters the ferromagnetic body which is an element forming the antenna, the flux hardly leaks. Therefore, the shape of the extension portion or the standing portion is not limited to the explained shape, and changes to the extent of not departing from the gist of the invention, for example, provision of a slit, a hole portion or a notch at the extension portion according to a component in the radio-wave receiving device are possible. Particularly in the case of the radio controlled timepiece, the watch exterior is designed in various ways in many cases, and the shape of the extension portion and the standing portion can be freely selected according to the design of the watch exterior.

An antenna of the present invention can be equipped on a radio-wave receiving device requiring the detection of much more magnetic flux, is particularly suitable for a wrist-watch type radio controlled timepiece requiring small size and light weight by reducing a dead space as much as possible, and can also be employed for a portable radio, a transceiver and the like.

The invention claimed is:

1. An antenna constituted by a columnar magnetic core and a coil portion winding a conductor around the magnetic core, comprising:

an extension portion in a flat-plate state extended from an end portion of the magnetic core; and a standing portion provided at least on one-direction face of the extension portion, wherein the standing portion and the extension portion are provided as different parts, and the antenna is arranged inside a radio-wave receiving device for receiving a radio wave having information.

2. The antenna according to claim 1, wherein a magnetism-collecting member is provided in contact with or magnetically coupled with the standing portion or formed as an integral body with the standing portion.

3. The antenna according to claim 2, wherein the magnetism-collecting member is a flat-plate shape having a flat face opposed to the extension portion, and an area of the flat face of the magnetism-collecting member is larger than a sectional area of a joint portion between the standing portion and the magnetism-collecting member.

4. The antenna according to claim 2, wherein the magnetism-collecting member is disposed at least in one direction of a direction approaching from the standing portion to the magnetic core or a direction separating from the magnetic core.

5. The antenna according to claim 2, wherein a material constituting the magnetism-collecting member is different from a material constituting the standing portion.

6. The antenna according to claim 2, wherein the material constituting the standing portion is an insulating material, and the material constituting the magnetism-collecting member is an amorphous laminate material.

7. The antenna according to claim 2, wherein the standing portion or the magnetism-collecting member faces a side of entering a magnetic flux of the radio wave, or is provided at a side of a member that does not shield the magnetic flux of the radio wave of the radio-wave receiving device.

8. The antenna according to claim 7, wherein the radio-wave receiving device has either of or both of a windshield glass and a time display measure, and the standing portion or the magnetism-collecting member faces a side of the windshield glass or the time display measure.

9. The antenna according to claim 7, wherein a lateral end face of the standing portion or the magnetism-collecting member is planarly aligned with an upper opening end face, or is positioned from the upper opening end face to the center of the radio-wave receiving device.

10. The antenna according the claim 7, wherein the standing portion or the magnetism-collection faces a joint portion or an interdigitate portion of the radio-wave receiving device.

11. The antenna according to claim 7, wherein the member that does not shield the magnetic flux of the radio wave is back lid constituted by an insulating material, and the standing portion or the magnetism-collecting member is arranged at a side of the back lid.

12. The antenna according to claim 7, wherein the standing portion or the magnetic-collecting member has a plane with a wide area in the direction from which the radio wave comes, or has a widened thickness.

13. A radio-wave receiving device having the antenna according to claim 1 within an exterior at least partially formed by a non-conductor, wherein a circuit board required for an operation of the radio-wave receiving device is provided, and the circuit board is provided between a plurality of extension portions extended from an end portion of the magnetic core and arranged as a not to overlap both of the extension portions extended from a different end portion of the magnetic core in the planar view.

14. The radio-wave receiving device according to claim 13, wherein an anti-magnetic plate shielding magnetic field is provided and the anti-magnetic plate is arranged so as to overlap the extension portion in a planar view.

15. The radio-wave receiving device according to claim 13, wherein the anti-magnetic plate shielding a magnetic field is provided and arranged so as not to overlap both of the extension portions extended from a different end portion of the magnetic core in the planar view.

16. The radio-wave receiving device according to claim 13, having at least one member in the extension portion, standing portion, magnetism-collecting member and a second standing portion, and the magnetism-collecting member, wherein the entire member is arranged overlapping a portion being a non-conductor of the exterior in the planar view.

17. The radio-wave receiving device according to claim 13, having the exterior of the radio-wave receiving device composed of a back lid and a watch case fitted with the back lid as well as a windshield glass; and being a radio controlled timepiece provided with a dial plate or a time display measure.

18. The antenna according to claim 1, wherein the standing portion is curved inward with respect to the magnetic core.

* * * * *

UNITED STATES PATENT AND TRADEMARK OFFICE

CERTIFICATE OF CORRECTION

PATENT NO. : 8,059,053 B2
APPLICATION NO. : 12/293481
DATED : November 15, 2011
INVENTOR(S) : Ryo Miyazaki et al.

It is certified that error appears in the above-identified patent and that said Letters Patent is hereby corrected as shown below:

Column 24, Line 19, Claim 10, “according the” should read -- according to --

Column 24, Line 23, Claim 11, “is back lid” should read -- is a back lid --

Column 24, Line 38, Claim 13, delete “as a” and insert -- so as --

Column 24, Line 42, Claim 14, “shielding magnetic” should read -- shielding a magnetic --

Column 24, Lines 52-53, Claim 16, “standing portion, magnetism-collecting member and a second standing portion, and the magnetism-collecting member, wherein” should read -- standing portion, and the magnetism-collecting member, wherein --

Signed and Sealed this
Twenty-eighth Day of February, 2012

David J. Kappos

David J. Kappos
*Director of the United States Patent and Trademark Office*